US010060155B2

(12) United States Patent
Molina et al.

(10) Patent No.: US 10,060,155 B2
(45) Date of Patent: Aug. 28, 2018

(54) METHOD AND APPARATUS FOR CONSTRUCTION WHEN VERTICAL AND HORIZONTAL MEMBERS ARE USED

(71) Applicant: American Fence System, Inc., South Plainfield, NJ (US)

(72) Inventors: Jesus Molina, Martinsville, NJ (US); Gerardo Molina, Edison, NJ (US)

(73) Assignee: American Fence System, Inc., South Plainfield, NJ (US)

( * ) Notice: Subject to any disclaimer, the term of this patent is extended or adjusted under 35 U.S.C. 154(b) by 551 days.

(21) Appl. No.: 14/855,457

(22) Filed: Sep. 16, 2015

(65) Prior Publication Data

US 2016/0097215 A1 Apr. 7, 2016

Related U.S. Application Data

(63) Continuation-in-part of application No. 14/505,091, filed on Oct. 2, 2014, now abandoned.

(51) Int. Cl.
*E04H 17/14* (2006.01)
*E04F 11/18* (2006.01)

(52) U.S. Cl.
CPC ..... *E04H 17/1443* (2013.01); *E04F 11/1817* (2013.01); *E04H 17/1439* (2013.01); *E04F 2011/1819* (2013.01); *E04H 2017/1465* (2013.01); *Y10T 29/49826* (2015.01)

(58) Field of Classification Search
CPC . E04H 17/14; E04H 17/1439; E04H 17/1443; E04H 17/1413; E04H 17/1417; E04H 17/1421; E04H 17/1426; E04H 2017/1447; E04H 2017/1465; E04F 11/181
See application file for complete search history.

(56) References Cited

U.S. PATENT DOCUMENTS

| | | | |
|---|---|---|---|
| 262,448 | A | 8/1882 | Maunder |
| 469,519 | A | 2/1892 | Hale |
| 2,218,953 | A | 10/1940 | Gustafson |
| 3,921,960 | A | 11/1975 | Bright |
| 5,454,548 | A | 10/1995 | Moore |
| 6,752,386 | B1 | 6/2004 | Bundy |
| 6,824,123 | B2 | 11/2004 | Larsen et al. |
| 7,152,849 | B2 | 12/2006 | Graber |
| 7,360,754 | B2 | 4/2008 | Robbins |
| 2004/0188663 | A1 | 9/2004 | Stein |
| 2005/0045863 | A1 | 3/2005 | MacKay |
| 2008/0157049 | A1 | 7/2008 | Robbins |
| 2014/0091269 | A1 | 4/2014 | Ramon |

*Primary Examiner* — Daniel J Wiley
(74) *Attorney, Agent, or Firm* — Lerner, David, Littenberg, Krumholz & Mentlik, LLP

(57) ABSTRACT

An apparatus including a first rail and a first locking strip, each having a first opening, and a first picket, having a first slot. The first locking strip may be inserted into the first rail so that the first openings of the first rail and the first locking strip align in a non locked state. At least part of the first picket may be inserted into the first openings of the first locking strip and the first rail, when the first openings of the first locking strip and the first rail are aligned in the non locked state. The first locking strip is configured to slide into a locked state in which part of the first locking strip is within the first slot of the first picket, while the first locking strip is within the first rail, and while the first picket is inserted in the first rail.

10 Claims, 38 Drawing Sheets

METHOD AND APPARATUS FOR CONSTRUCTION WHEN VERTICAL AND HORIZONTAL MEMBERS ARE USED

CROSS REFERENCE TO RELATED APPLICATION(S)

The present application is a continuation in part of and claims the priority of U.S. patent application Ser. No. 14/505,091, titled "METHOD AND APPARATUS FOR CONSTRUCTION WHEN VERTICAL AND HORIZONTAL MEMBERS ARE USED", filed on Oct. 2, 2014.

FIELD OF THE INVENTION

This invention relates to improved methods and apparatus concerning construction when vertical and horizontal members are used, such as for constructing fences, railings and gates.

BACKGROUND OF THE INVENTION

There are various devices known in the prior art for constructing fences.

SUMMARY OF THE INVENTION

At least one embodiment of the present application includes an apparatus comprising a first rail having a first opening, a first locking strip having a first opening, and a first picket having a first slot. The first locking strip may be configured to be at least partially inserted into an inner chamber of the first rail so that the first opening of the first rail aligns with the first opening of the first locking strip in a first state, which may be an open or non locked state. At least part of the first picket is configured to be inserted into the first opening of the first locking strip and into the first opening of the first rail, when the first opening of the first locking strip and the first opening of the first rail are aligned in the first, open, or non locked state. The first locking strip is configured to slide into a second or locked state in which part of the first locking strip is within the first slot of the first picket, while at least part of the first locking strip is inside the inner chamber of the first rail, and while at least part of the first picket is inside the inner chamber of the first rail.

The first rail may have first, second, and third sides. The first and third sides may be parallel to each other and perpendicular to the second side. The second side may have the first opening of the first rail. The first picket may be elongated such that the first picket has a length and a width, and the length of the first picket is substantially longer than the width. The first slot of the first picket may run the entire width of the first picket. The first slot of the first picket may run a distance along the length of the first picket which is substantially less than the width of the first picket. The first rail may have first and second internal ribs inside the inner chamber of the first rail which run the majority of the length of the first rail, and on which the first locking strip can slide inside the inner chamber of the first rail. The first and second internal ribs may be parallel to each other and spaced apart from each other. The first rail may have a length and a width, and the length of the first rail may be substantially greater than the width of the first rail. The first opening of the first locking strip may have a first part having a first width and a second part having a second width, wherein the first and the second width of the first locking strip are in the direction of the width of the first rail.

The apparatus may include one or more further pickets, each of which has a first slot; wherein the first rail has one or more further openings and the first locking strip has one or more further openings. The first locking strip may be configured to be at least partially inserted into the inner chamber of the first rail so that each of the first opening and the one or more further openings of the first rail align with one of the first opening and the one or more further openings of the first locking strip in the first, open, or unlocked state. At least part of the one or more further pickets is configured to be inserted into a corresponding opening of the one or more further openings of the first locking strip and a corresponding opening of the one or more further openings of the first rail, when each of the one or more further openings of the first locking strip and the corresponding one or more further openings of the first rail are aligned in the first state.

The first locking strip is configured to slide into the second or locked state in which part of the first locking strip is within each first slot of the first picket and each of the one or more further pickets, while at least part of the first locking strip is inside the inner chamber of the first rail, and while at least part of the first picket and the one or more further pickets is inside the inner chamber of the first rail.

The apparatus may further include a second rail, and a second locking strip. Each of the first picket and the one or more further pickets may have a second slot. The second rail may have a first opening and one or more further openings and the second locking strip may have a first opening and one or more further openings. The second locking strip may be configured to be at least partially inserted into an inner chamber of the second rail so that each of the first opening and the one or more further openings of the second rail align with one of the first opening and the one or more further openings of the second locking strip in a third state. At least part of the first picket and the one or more further pickets may be configured to be inserted into a corresponding opening of the first opening and the one or more further openings of the second locking strip and a corresponding opening of the first opening and the one or more further openings of the second rail, when each of the first opening and the one or more further openings of the second locking strip and the corresponding first opening and the one or more further openings of the second rail are aligned in the third, opened, or unlocked state. The second locking strip is configured to slide into a fourth or locked state in which part of the second locking strip is within each second slot of the first picket and each of the one or more further pickets, while at least part of the second locking strip is inside the inner chamber of the second rail, and while at least part of the first picket and the one or more further pickets is inside the inner chamber of the second rail.

The apparatus may further include a first post having a first opening, and a second locking strip having a first opening. The second locking strip may be configured to be inserted into an inner chamber of the first post so that the first opening of the first post is aligned with the first opening of the second locking strip in a third state, while at least part of the first rail is inserted into the first opening of the first post and the first opening of the second locking strip.

A method is also provided which may include inserting a first picket having a first slot into a first opening of a first rail and a first opening of a first locking strip in a first state, in which the first opening of the first rail and the first opening of the first locking strip are aligned; and sliding the first locking strip into a second state so that a part of the first locking strip lies in a first slot of the first picket and thereby inhibits removal of the first picket from the first rail. The first rail may have first, second, and third sides; and wherein the first and third sides may be parallel to each other and perpendicular to the second side; and wherein the second side has the first opening of the first rail. The first picket may be elongated such that the first picket has a length and a width, and the length of the first picket is substantially longer than the width; and wherein the first slot of the first picket runs the entire width of the first picket. The first slot of the first picket may run a distance along the length of the first picket which is substantially less than the width of the first picket.

The first rail may have first and second internal ribs inside the inner chamber of the first rail which run the majority of the length of the first rail, and on which the first locking strip can slide inside the inner chamber of the first rail; and wherein the first and second internal ribs are parallel to each other and spaced apart from each other The first rail may have a length and a width, and the length of the first rail is substantially greater than the width of the first rail; and wherein the first opening of the first locking strip has a first part having a first width and a second part having a second width, wherein the first and the second width of the first locking strip are in the direction of the width of the first rail.

The method may further include inserting one or more further pickets, each of which has a first slot, into one or more further openings of the first rail, and into one or more further openings of the first locking strip; and wherein the first locking strip is configured to be at least partially inserted into the inner chamber of the first rail so that each of the first opening and the one or more further openings of the first rail align with one of the first opening and the one or more further openings of the first locking strip in the first state; and wherein at least part of the one or more further pickets is configured to be inserted into a corresponding opening of the one or more further openings of the first locking strip and a corresponding opening of the one or more further openings of the first rail, when each of the one or more further openings of the first locking strip and the corresponding one or more further openings of the first rail are aligned in the first state; and wherein the first locking strip is configured to slide into the second state in which part of the first locking strip is within each first slot of the first picket and each of the one or more further pickets, while at least part of the first locking strip is inside the inner chamber of the first rail, and while at least part of the first picket and the one or more further pickets is inside the inner chamber of the first rail.

The method may further include inserting a second locking strip at least partially into a second rail, so that a first opening and one or more further openings of the second locking strip align with a first opening and one or more further openings of the second rail in a third state; and inserting at least part of the first picket and the one or more further pickets into the corresponding first opening and one or more further openings of the second rail and the second locking strip; wherein each of the first picket and the one or more further pickets has a second slot; and wherein at least part of the first picket and the one or more further pickets is configured to be inserted into a corresponding opening of the first opening and the one or more further openings of the second locking strip and a corresponding opening of the first opening and the one or more further openings of the second rail, when each of the first opening and the one or more further openings of the second locking strip and the corresponding first opening and the one or more further openings of the second rail are aligned in the third state. The second locking strip may be configured to slide into a fourth state in which part of the second locking strip is within each second slot of the first picket and each of the one or more further pickets, while at least part of the second locking strip is inside the inner chamber of the second rail, and while at least part of the first picket and the one or more further pickets is inside the inner chamber of the second rail.

The method may further include inserting a second locking strip into a first post; wherein the first post has a first opening; wherein the second locking strip has a first opening; and wherein the second locking strip is configured to be inserted into an inner chamber of the first post so that the first opening of the first post is aligned with the first opening of the second locking strip in a third state, while at least part of the first rail is inserted into the first opening of the first post and the first opening of the second locking strip.

The method may further include inserting a second locking strip into a first post; wherein the second locking strip has a first and a second opening; wherein the first post has a first and a second opening; wherein the second locking strip is configured to be inserted into an inner chamber of the first post so that the first and the second opening of the first post is aligned with the first and the second opening of the second locking strip in a third state, while at least part of the first and the second rails are inserted into the first and the second openings of the first post and the first and the second openings of the second locking strip, respectively.

DETAILED DESCRIPTION OF THE DRAWINGS

Figure 1A:
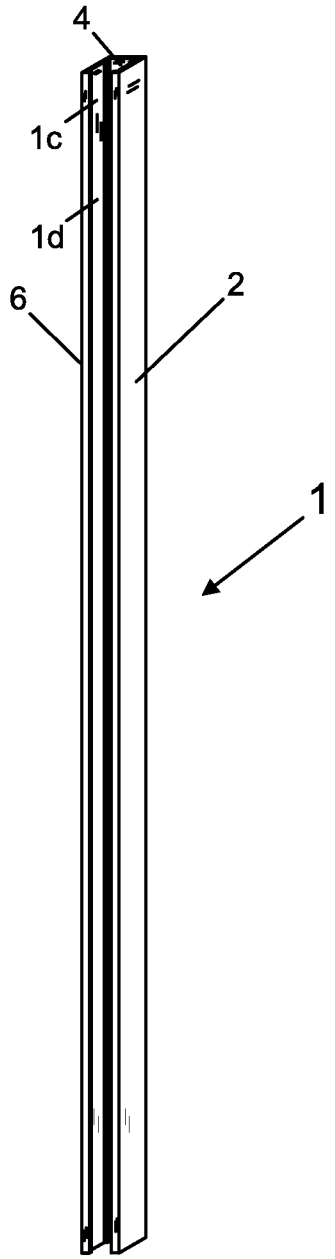
FIG. 1A shows a top, front, and right side view of a horizontal member or rail in accordance with an embodiment of the present invention.
Figure 1B:
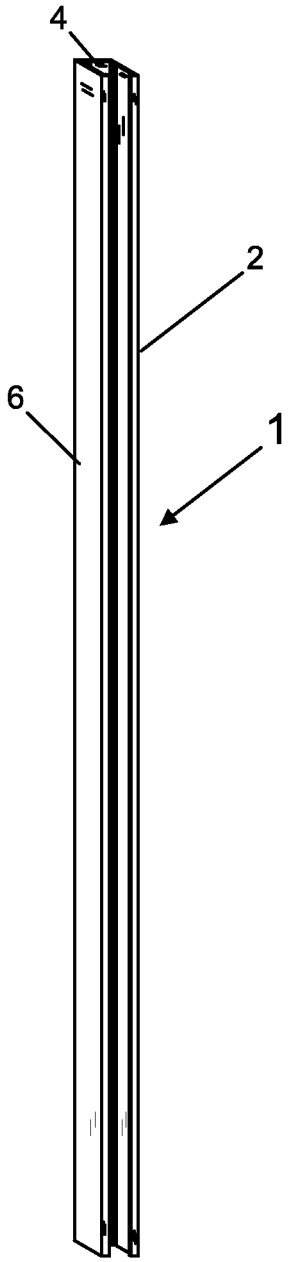
FIG. 1B shows a top, front, and left side view of the horizontal member or rail of FIG. 1A.
Figure 1C:
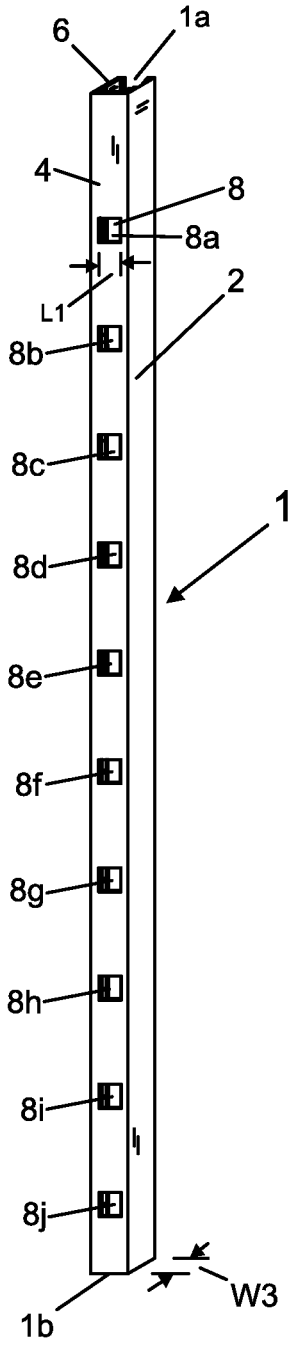
FIG. 1C shows a bottom, rear, and right side view of the horizontal member or rail of FIG. 1A.
Figure 1D:
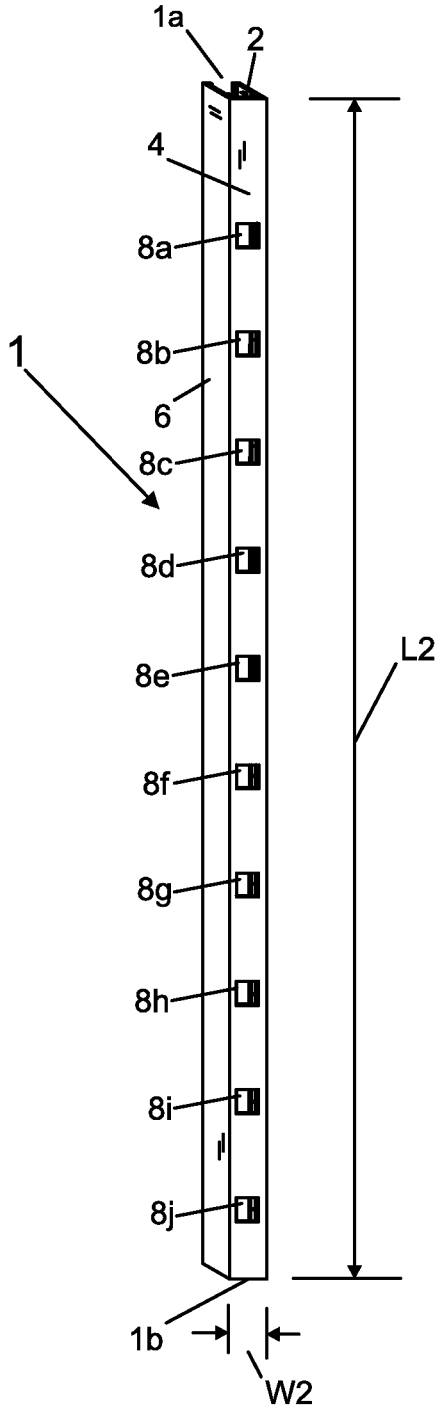
FIG. 1D shows a bottom, rear, and left side view of the horizontal member or rail of FIG. 1A.
Figure 1E:
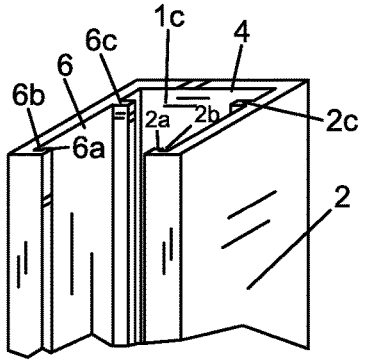
FIG. 1E shows a top, front, and right side closeup perspective view of part of the horizontal member or rail of FIG. 1A.
Figure 1F:
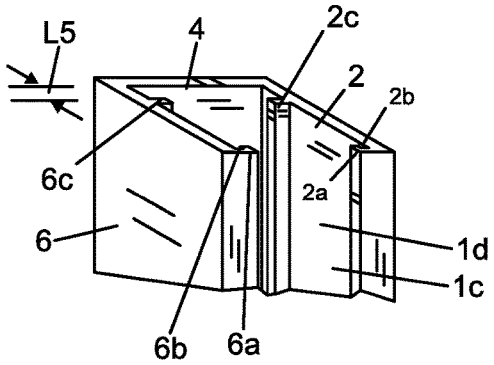
FIG. 1F shows a top, front, and left side closeup perspective view of part of the horizontal member or rail of FIG. 1A.
Figure 1G:
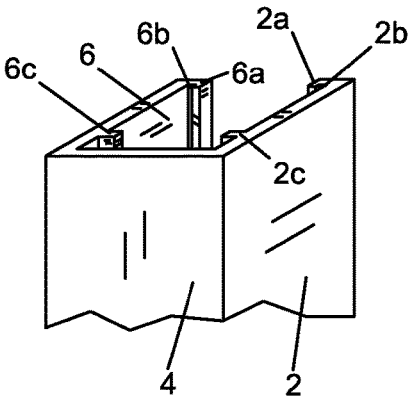
FIG. 1G shows a bottom, rear, and right side closeup perspective view of part of the horizontal member or rail of FIG. 1A.
Figure 1H:
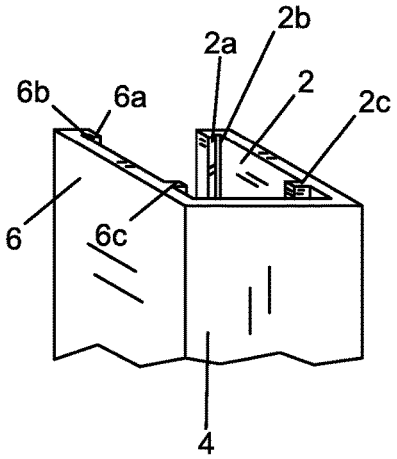
FIG. 1H shows a bottom, rear, and left side closeup perspective view of part of the horizontal member or rail of FIG. 1A.

FIG. 1A shows a top, front, and right side view of a horizontal member or rail 1 in accordance with an embodiment of the present invention. FIG. 1B shows a top, front, and left side view of the horizontal member or rail 1. FIG. 1C shows a bottom, rear, and right side view of the horizontal member or rail 1. FIG. 1D shows a bottom, rear, and left side view of the horizontal member or rail 1. FIG. 1E shows a top, front, and right side closeup perspective view of part of the horizontal member or rail 1. FIG. 1F shows a top, front, and left side closeup perspective view of part of the horizontal member or rail 1. FIG. 1G shows a bottom, rear, and right side closeup perspective view of part of the horizontal member or rail 1. FIG. 1H shows a bottom, rear, and left side closeup perspective view of part of the horizontal member or rail 1.

The rail 1 includes sides 2, 4, and 6 which form a U-shape as shown in FIG. 1A-1H. The side 4 includes a plurality of openings 8, which includes openings 8*a*, 8*b*, 8*c*, 8*d*, 8*e*, 8*f*, 8*g*, 8*h*, 8*i*, and 8*j* as shown in FIGS. 1C and 1D. The openings 8*a*-8*j* may be square shaped or substantially square shaped, and each of the openings 8*a*-8*j* may have a side length of L1, as shown in FIG. 1C which may be about one inch. The rail 1 may have an overall length L2, which may be about fifty-four inches, an overall width W2, which be about one and five eighth of an inch, and an overall width W3 which may be about one and five eighths inches, as shown by FIGS. 1C and 1D.

The side 6 may have a protrusion or inner rail 6*c*, a protrusion or inner rail 6*a*, and a groove or indentation 6*b* as shown in FIGS. 1E-1H. In at least one embodiment, the inner rails 6*c* and 6*a* and the groove 6*b* run for the entire overall length L2 of the rail 1. Similarly or identically the side 2 may have a protrusion or inner rail 2*c*, a protrusion or inner rail 2*a*, and a groove or indentation 2*b* as shown in FIGS. 1E-1H. In at least one embodiment, the inner rails 2*c* and 2*a* and the groove 2*b* run for the entire overall length L2 of the rail 1. The inner rails 6*a* and 2*a* provide additional strength to the rail 1, and reduces or eliminates rattle for the rail 1.

The rail 1 may be made entirely of a hard material, such as steel, other material such as aluminum, plastic, or composites or other fence material. The rail 1 may have an end 1*a* and an opposing end 1*b*, as shown in FIGS. 1C and 1D. The rail 1 may have an opening or slot 1*c*, shown in FIG. 1A, leading to an inner chamber 1*d* which is substantially enclosed by the sides or walls 2, 4, and 6; and both slot 1*c* and chamber 1*d* run the entire length L2 of the rail 1.

Figure 2A:
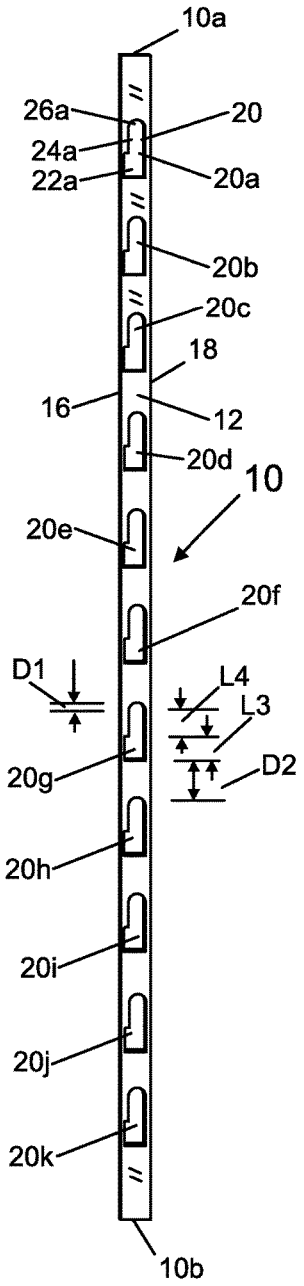
FIG. 2A shows a top, front, and left side view of a locking strip for use with the rail of FIG. 1A in accordance with an embodiment of the present invention.
Figure 2B:
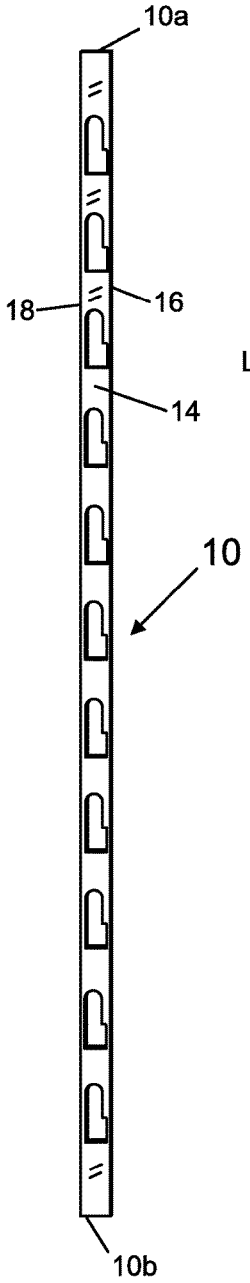
FIG. 2B shows a top, rear, and left side view of the locking strip of FIG. 2A.
Figure 2C:
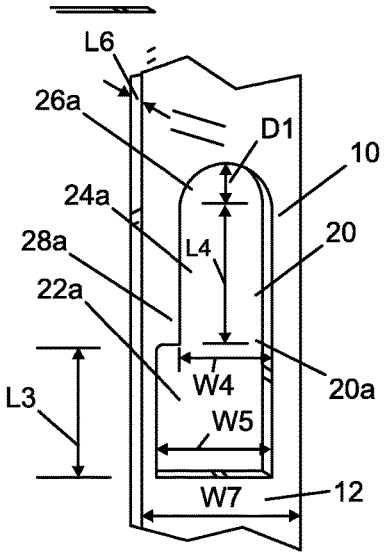
FIG. 2C shows a top, front, and left side closeup view of part of the locking strip of FIG. 2A.
Figure 2D:
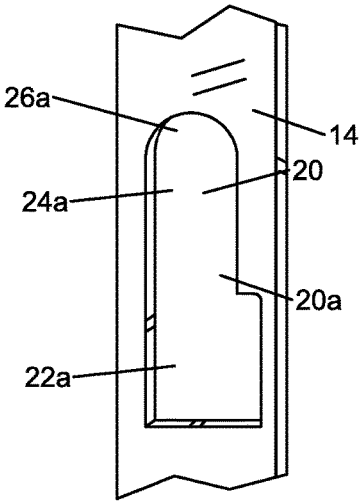
FIG. 2D shows a top, rear, and left side closeup view of part of the locking strip of FIG. 2A.

FIG. 2A shows a top, front, and left side view of a locking strip 10 for use with the rail 1 of FIG. 1A in accordance with an embodiment of the present invention. FIG. 2B shows a top, rear, and left side view of the locking strip 10. FIG. 2C shows a top, front, and left side closeup view of part of the locking strip 10. FIG. 2D shows a top, rear, and left side closeup view of part of the locking strip 10.

The locking strip 10 includes top surface 12, rear surface 14, left edge 16, right edge 18, first end 10*a*, and second opposing end 10*b*. The locking strip 10 also includes a plurality of openings 20, which includes opening 20*a*. Each of the openings 20, including opening 20*a* may be identical and therefore only opening 20*a* will be described in detail. Opening 20*a* includes top semicircular portion 26*a*, a central rectangular portion 24*a*, and a bottom portion 22*a*. The top portion 26*a* may have a diameter D5, which may be about one quarter of an inch. The central portion 24*a* may have a length L4 of about one and one quarter inches, and a width W4 which may be about three quarters of an inch. The width W4 of the rectangular section 24*a* is preferably less than the width W6 of the picket 30, shown in FIG. 3D. These dimensions enable and/or assist in locking the picket 30 in place in the with the locking strip 10. The portion 22*a* has a width W5 which may be shown in FIG. 2C which may be about one inch or about the side length L1 of each of the openings 8 of the rail 1 shown in FIG. 1C. The bottom portion 22*a* may have a length L3 which may be one and one quarter inches. The bottom portion 22*a*, in at least one embodiment is at least as large as each of the openings 8 of the rail 1, to allow picket 30 shown in FIG. 3A to pass through both the bottom portion 22*a* of the locking strip 10, and the opening 8 of the rail 1 as shown for example by FIGS. 5C, 5D, 6B, and 7A.

Figure 3A:
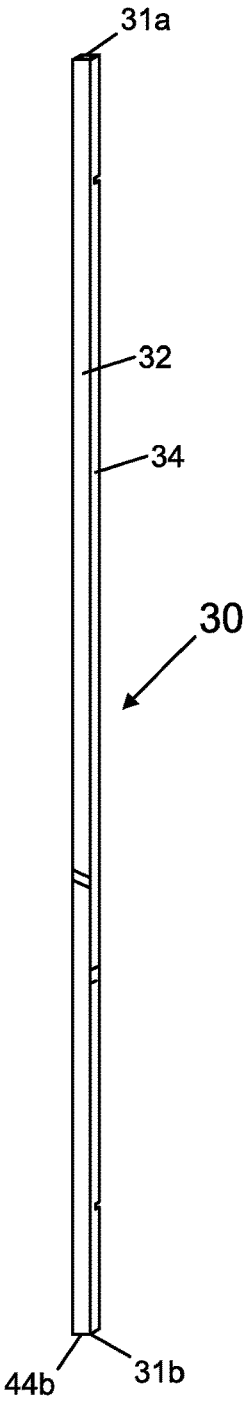
FIG. 3A shows a top, front, and right side perspective view of a vertical member or picket for use with the rail of FIG. 1A and the locking strip of FIG. 2A.
Figure 3B:
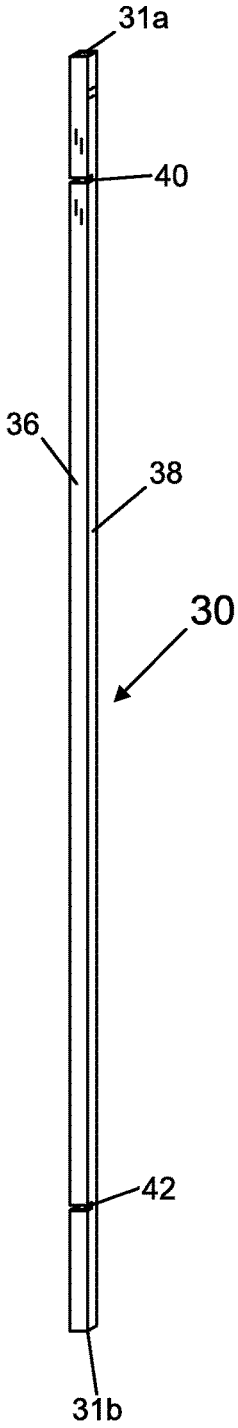
FIG. 3B shows a top, rear, and left side perspective view of the vertical member or picket of FIG. 3A.
Figure 3C:
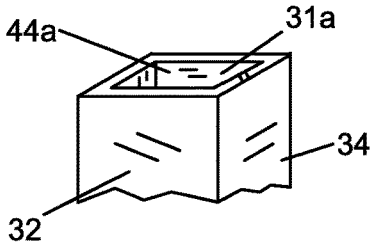
FIG. 3C shows a top, front, and right side perspective closeup view of part of the vertical member or picket for use with the rail of FIG. 1A and the locking strip of FIG. 2A.
Figure 3D:
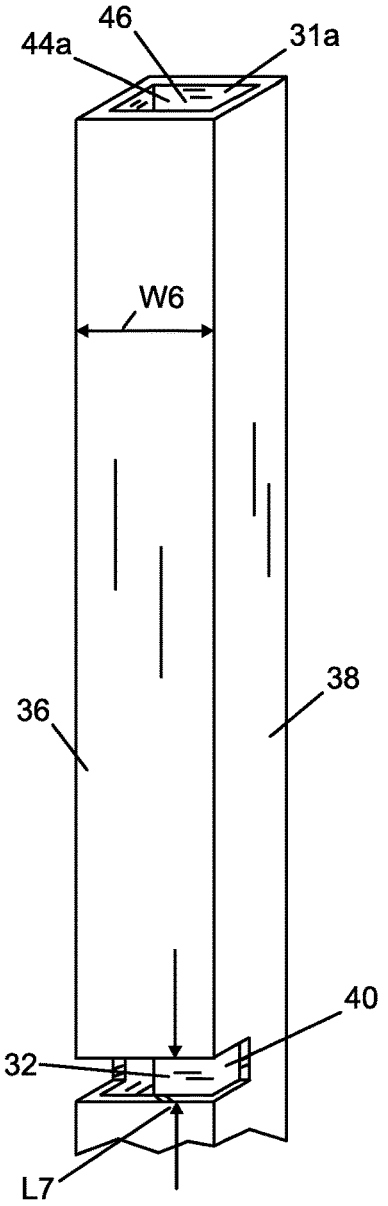
FIG. 3D shows a top, rear, and left side perspective closeup view of part of the vertical member or picket of FIG. 3A.

The slots 40 and 42 may have a dimension L7 along the length of the picket 30, shown in FIG. 3D, which may be substantially less than the width D6 of the picket 30 and the slots 40 and 42. For example the length L7 may be one half or less than one half of the width W6.

Figure 12:
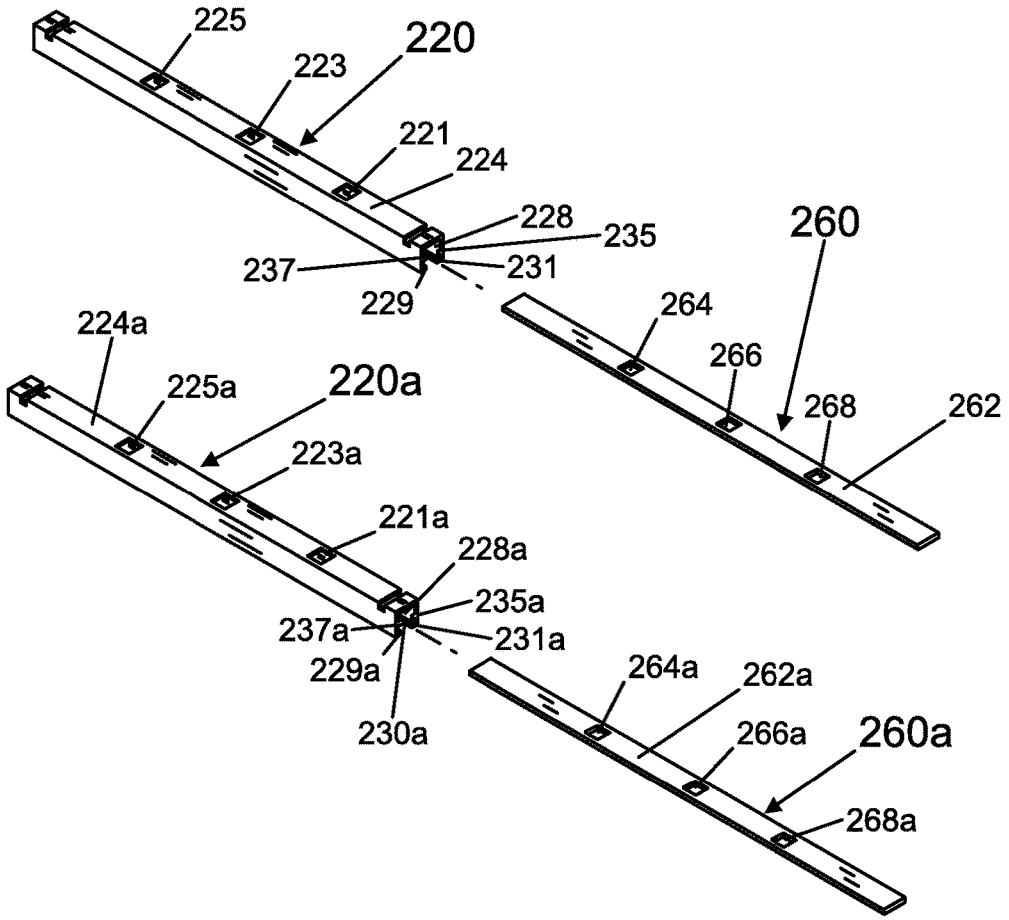
FIG. 12 shows a perspective view of the rail of FIGS. 10A-10D along with an identical rail; and the locking strip of FIGS. 11A-11B along with an identical locking strip, with the locking strips shown separated from the rails.

The locking strip 10 may be replaced by a locking strip similar or identical to locking strip 260 having square or substantially square openings 264, 266, and 268, as shown in FIG. 12, and the locking strip may have any number of square openings analogous to opening 264.

There is a distance D2, which may be two inches, between each pair of the plurality of openings 20. The uniform distance D2 is used to allow the bottom openings of the openings 20 (such as bottom opening 22*a* of the opening 20*a*, and corresponding bottom openings for other openings of 20*b*-20*k*) to be aligned with the openings 8 of the rail 8. I.e. bottom openings of openings 20*a*-20*j* shown in FIG. 2A are configured so that they can be aligned with openings 8*a*-8*j*, respectively, of rail 1 of FIG. 1. The bottom openings of 20*b*-20*k* could also be aligned with openings 8*a*-8*j*, respectively or rail 1 or if the locking strip is turned upside down, openings 20*k*-20*b* could be aligned with 8*a*-8*j* or openings 20*j*-20*a* could be aligned with openings 8*a*-8*j*, respectively.

The locking strip 10 may be made of hard plastic or metal or any other material shaped in locking strip fashion.

FIG. 3A shows a top, front, and right side perspective view of a vertical member or picket 30 for use with the rail 1 of FIG. 1A and the locking strip 10 of FIG. 2A. FIG. 3B shows a top, rear, and left side perspective view of the vertical member or picket 30. FIG. 3C shows a top, front, and right side perspective closeup view of part of the vertical member or picket 30 for use with the rail 1 and the locking strip 10. FIG. 3D shows a top, rear, and left side perspective closeup view of part of the vertical member or picket 30.

The vertical member or picket 30 includes sides or walls 32, 34, 36, and 38. The picket 30 may be substantially in the form of a rectangular tube. However, the picket 30 may be, or may be replaced by a round picket, or solid picket, as long has typically the picket has notches or slots similar or identical to notches or slots 40 and 42.

The picket 30 has openings 44*a* and 44*b* at ends 31*a* and 31*b* respectively. The openings 44*a* and 44*b* lead to inner chamber 46 which is enclosed or substantially enclosed by walls 32, 34, 36, and 38. The picket 30 has slots 40 and 42. The slots 40 and 42 cut through the entire wall 36, and through about half of each of walls 38 and 34, in at least one embodiment. The slots 40*a* and 42 allow access to the inner chamber 46.

The picket 30 may be square hollow tube or a substantially square hollow tube, with the exception of slots 40 and 42, and the picket 30 may have a width W6 which is about one inch and which is slightly less than the length L1 of each of the openings 8*a*-8*j* of the rail 1 shown in FIG. 1A. This allows the picket 30 to be inserted into any one of the openings 8*a*-8*j* of the rail 1 as shown in FIGS. 5C-5D, and 6B. The picket 30 may be made of a hard material, such as aluminum, steel, plastic, or composite.

Figure 4A:
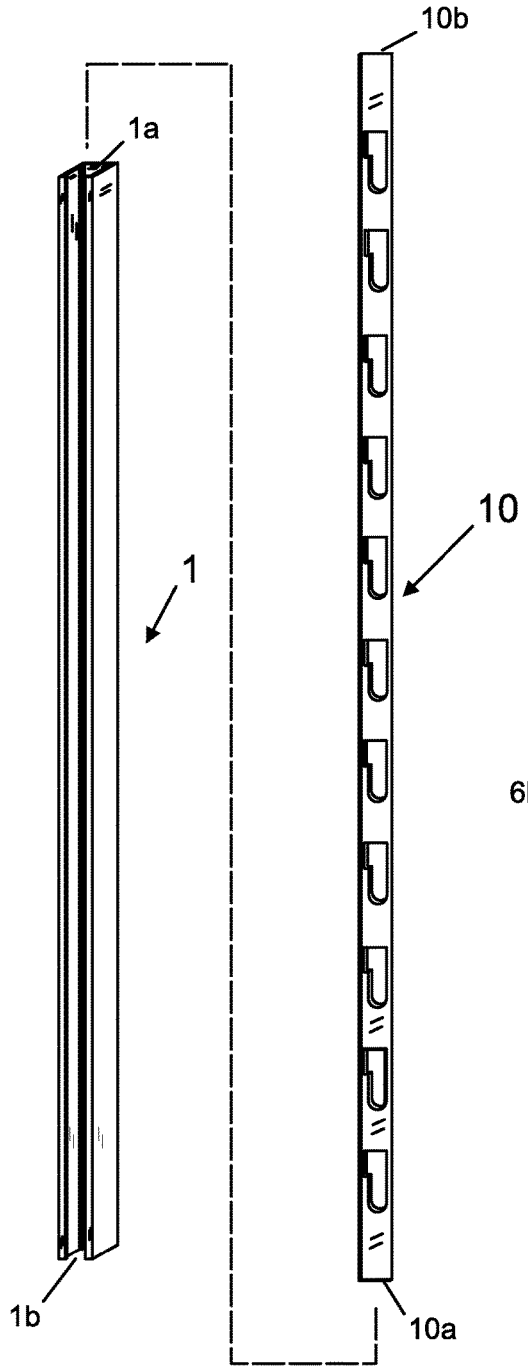
FIG. 4A shows a top, front, and right side view of the horizontal member or rail of FIG. 1A along with a perspective view of the locking strip of FIG. 2A.
Figure 4B:
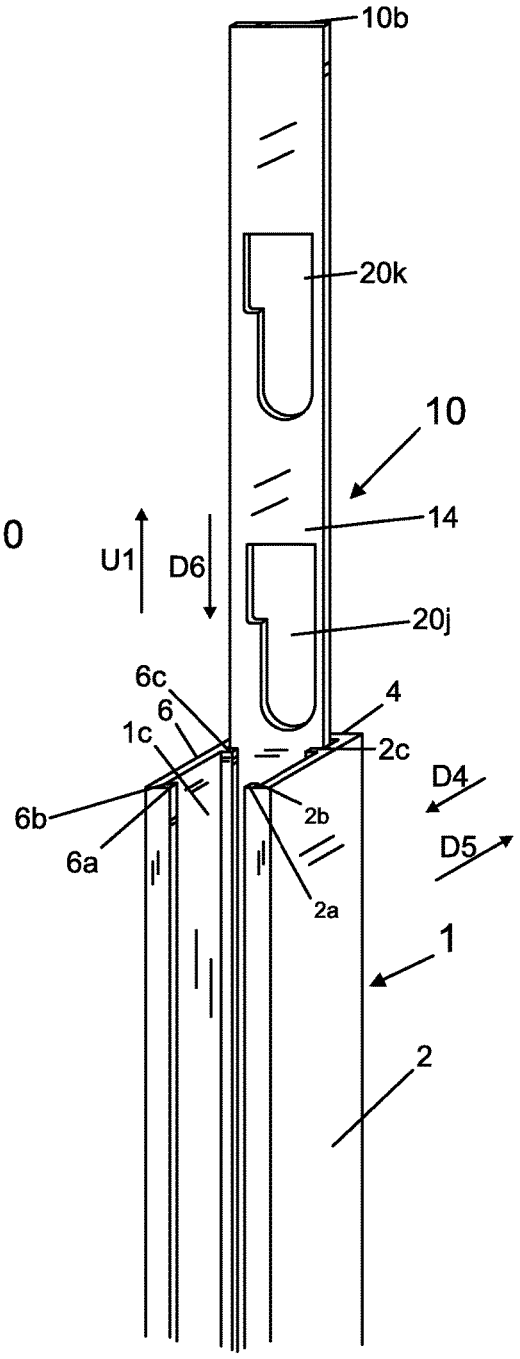
FIG. 4B shows a top, front, and right side closeup view of part of the horizontal member or rail of FIG. 1A along with a perspective closeup view of part of the locking strip of FIG. 2A with the locking strip partially inserted into the rail of FIG. 1A.

FIG. 4A shows a top, front, and right side view of the horizontal member or rail 1 of FIG. 1A along with a perspective view of the locking strip 10. In FIG. 4A the rail 1 and the locking strip 10 are separated from each other. FIG. 4B shows a top, front, and right side closeup view of part of the horizontal member or rail 1 of FIG. 1A along with a perspective closeup view of part of the locking strip 10 of FIG. 2A with the locking strip 10 partially inserted into the rail 1 of FIG. 1A.

In FIG. 4B, the locking strip 10 has been partially inserted so that the strip is between the side 4 and the inner rails 6*c* and 2*c*. The locking strip 10 is thus prevented from moving in the direction D4 beyond the inner rails 6*c* and 2*c* and prevented from moving in the direction D5 beyond the wall 4. However, the locking strip 10 can slide in the directions U1 and D6 in the channel formed by the space between wall 4 and the combination of the inner rails 6*c* and 2*c*.

Figure 5A:
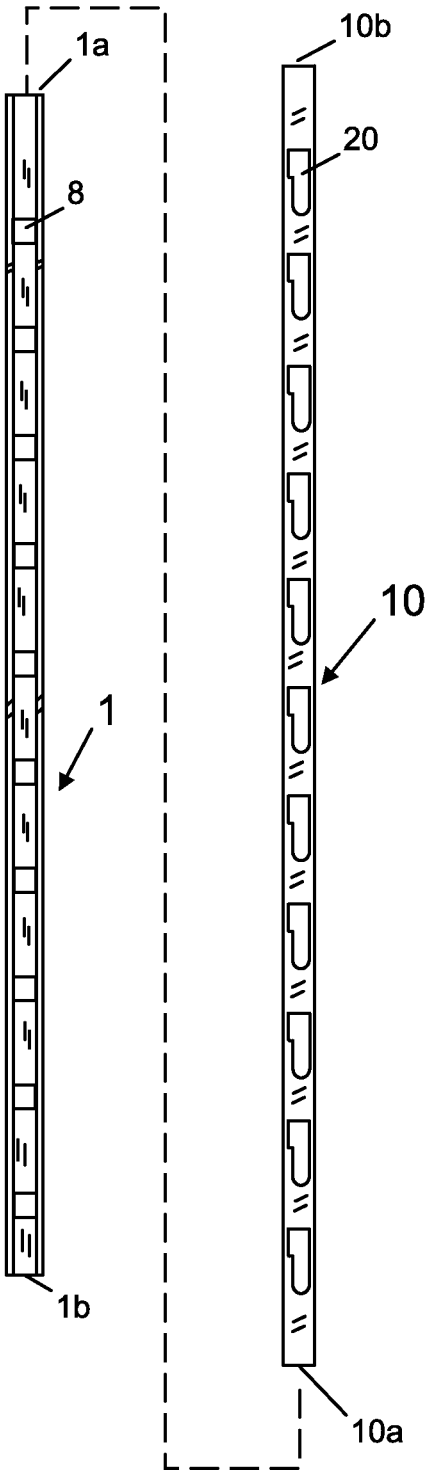
FIG. 5A shows a front view of the horizontal member or rail of FIG. 1A, and a rear view of the locking strip of FIG. 2A.
Figure 5B:
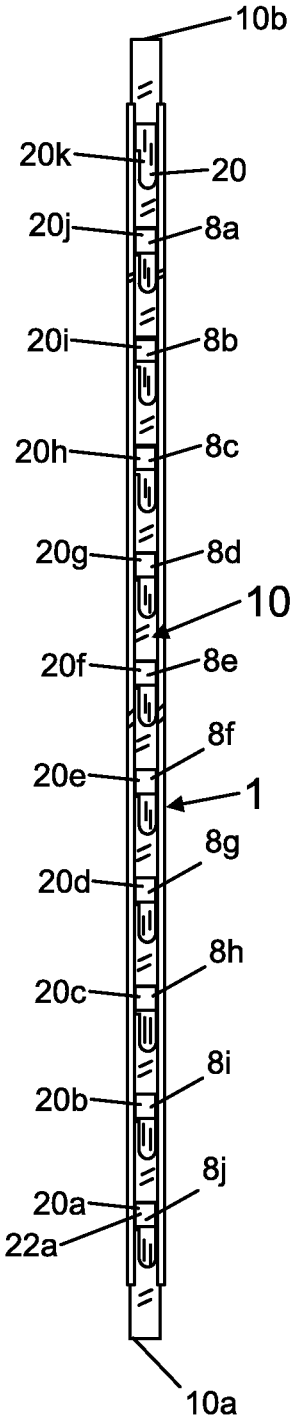
FIG. 5B shows a front view of the horizontal member or rail of FIG. 1A and a rear view of the locking strip of FIG. 2A with the locking strip inserted into the rail of FIG. 1A.
Figure 5C:
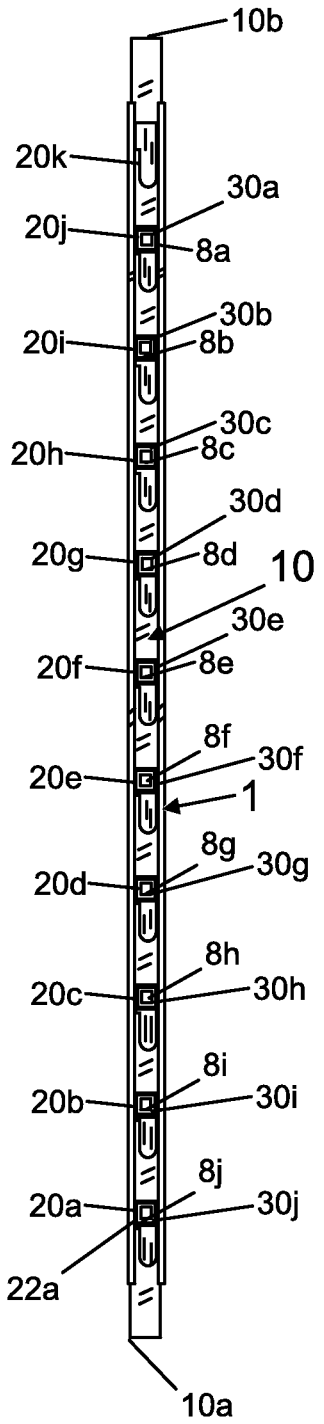
FIG. 5C shows a front view of the horizontal member or rail of FIG. 1A, a rear view of the locking strip of FIG. 2A, and a top view of a plurality of pickets identical to the picket of FIG. 3A, with the locking strip inserted into the rail of FIG. 1A, and the plurality of pickets inserted into openings of the rail and of the locking strip, with the locking strip in a first state.
Figure 5D:
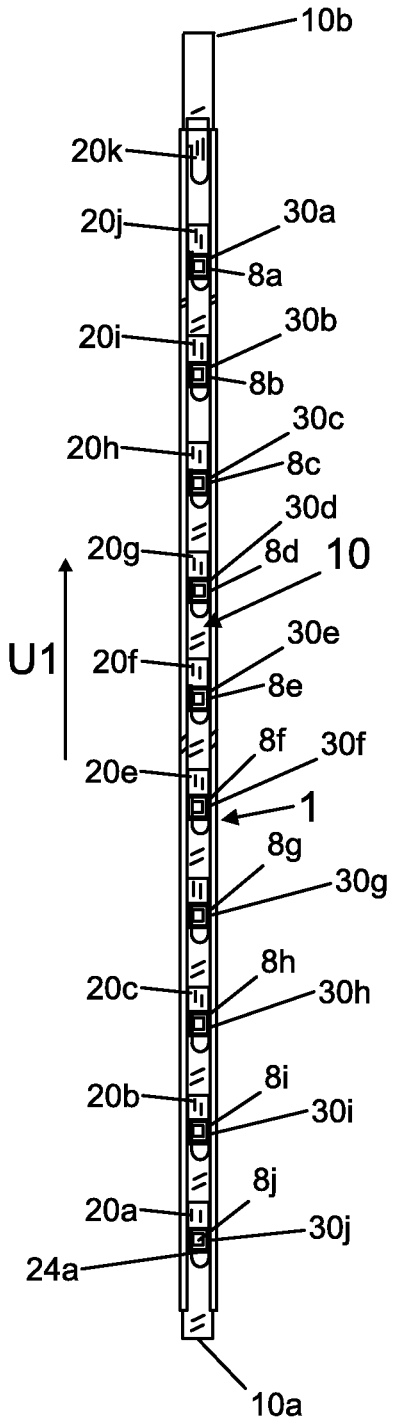
FIG. 5D shows a front view of the horizontal member or rail of FIG. 1A, a rear view of the locking strip of FIG. 2A, and a top view of a plurality of pickets identical to the picket of FIG. 3A, with the locking strip inserted into the rail of FIG. 1A, and the plurality of pickets inserted into openings of the rail and of the locking strip, and with the locking strip in a second state.

FIG. 5A shows a front view of the horizontal member or rail 1 of FIG. 1A, and a rear view of the locking strip 10 with the rail 1 and the locking strip 10 separate from each other. FIG. 5B shows a front view of the horizontal member or rail 1 and a rear view of the locking strip 10 with the locking strip 10 inserted into the rail 1, such that the locking strip is in a channel between the wall 4 and the combination of the inner rails 2*c* and 6*c* as in FIG. 4B. In addition, in FIG. 5B, the locking strip 10 has been slid into a position in which the bottom portions (analogous to bottom portion 22*a* of opening 20*a*) of openings 20*k*-20*a* are aligned with the openings 8*a*-8*j* respectively. The arrangement of FIG. 5B allows the picket 30 to be inserted through any of the aligned combinations of openings 20*k*-*a* and 8*a*-*j*, respectively.

FIG. 5C shows a front view of the horizontal member or rail 1 and a rear view of the locking strip 10, and a top view of a plurality of a pickets 30*a*-*j*, each identical to the picket 30, with the locking strip 10 inserted into the rail 1, and the plurality of pickets 30*a*-*j* inserted into openings 8*a*-*j*, respectively of the rail 1 and openings 20*k*-20*a*, respectively of the locking strip 10, with the locking strip 10 in a first state, in which the portion 22*a* of opening 20*a* (and the analogous portions of openings 20*b*-20*j*) are aligned with the openings 8*j*-8*a*.

FIG. 5D shows a front view of the horizontal member or rail 1 of FIG. 1A, a rear view of the locking strip 10 and a top view of a plurality of pickets 30*a*-*j* identical to the picket 30 of FIG. 3A, with the locking strip 10 inserted into the rail 1 of FIG. 1A, and the plurality of pickets 30*a*-*j* inserted into the openings 8*a*-8*j* of the rail 1 and the openings 20*k*-20*a* of the locking strip 10, respectively and with the locking strip 10 in a second state, in which the locking strip 10 has been slid up in the direction U1 shown in FIG. 5D, with respect to the rail 1. In FIG. 5D, the portion 24*a* shown in FIG. 2C of the opening 20*a* is now aligned with the opening 8*j* of the rail 1. Analogously the corresponding portions of the openings 20*b*-20*k* are now aligned with the openings 8*i*-8*a* of the rail 1. The slots 40 and 42 of the picket 30 allow the solid portion, flange, or protrusion 28*a* shown in FIG. 2C to move into the slots 40 and 42 of the picket, and of the analogous slots of pickets 30*a*-*j*. This permits the locking strip 10 to move into the second state or locking state. When the locking strip 10 is in the locking state of FIG. 5D with respect to the pickets 30*a*-*j*, the pickets 30*a*-*j* cannot be removed from the openings 8*a*-*j* of the rail 8, because they are prevented by the protrusion, flange or solid portion 28*a* shown in FIG. 2C.

Figure 6A:
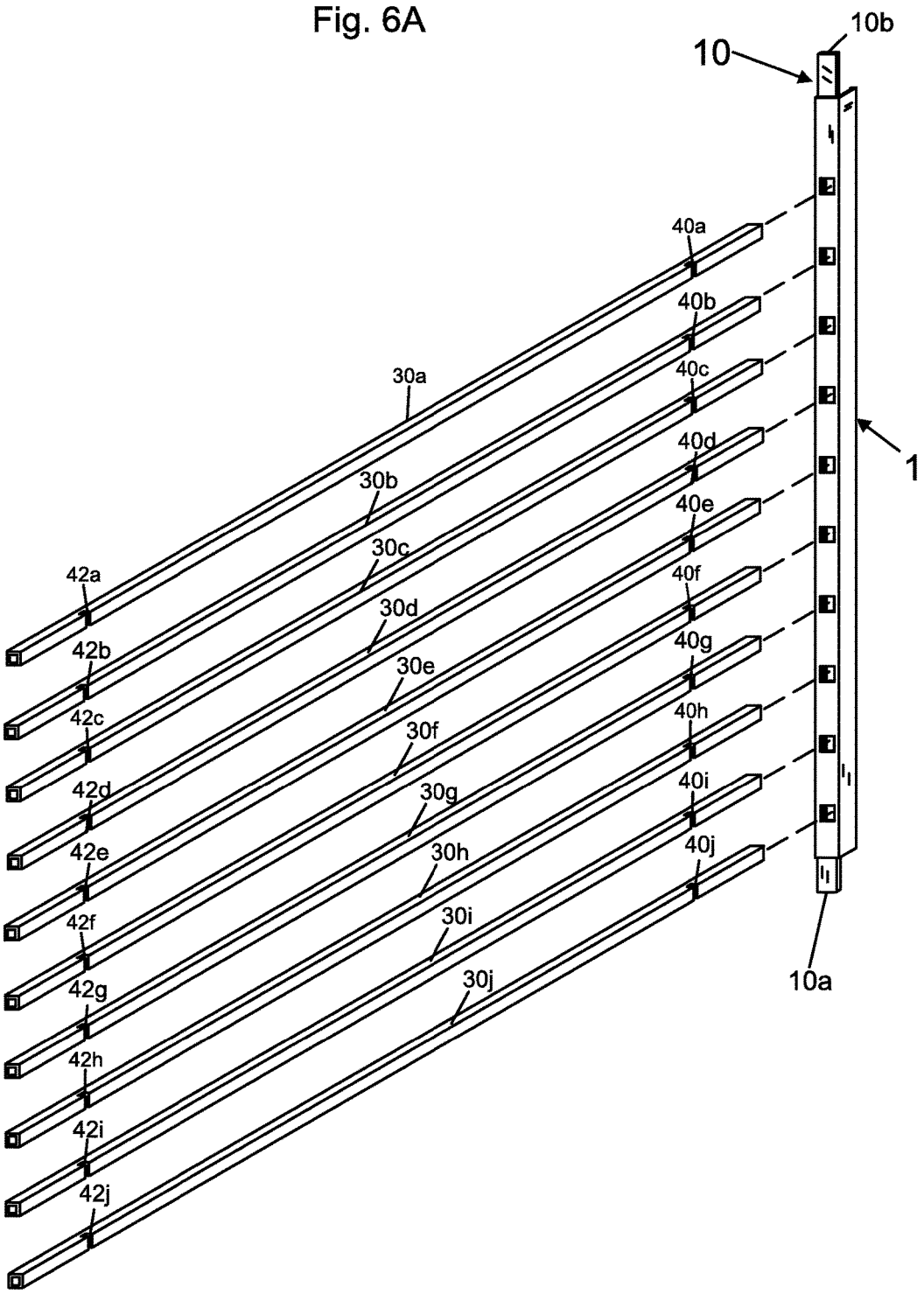
FIG. 6A shows a top, rear, and left side view of a plurality of pickets identical to the picket of FIG. 3A and a bottom, rear, and right side view of the rail of FIG. 1A, with the locking strip of FIG. 2A inserted into the rail, and the locking strip in a first state.
Figure 6B:
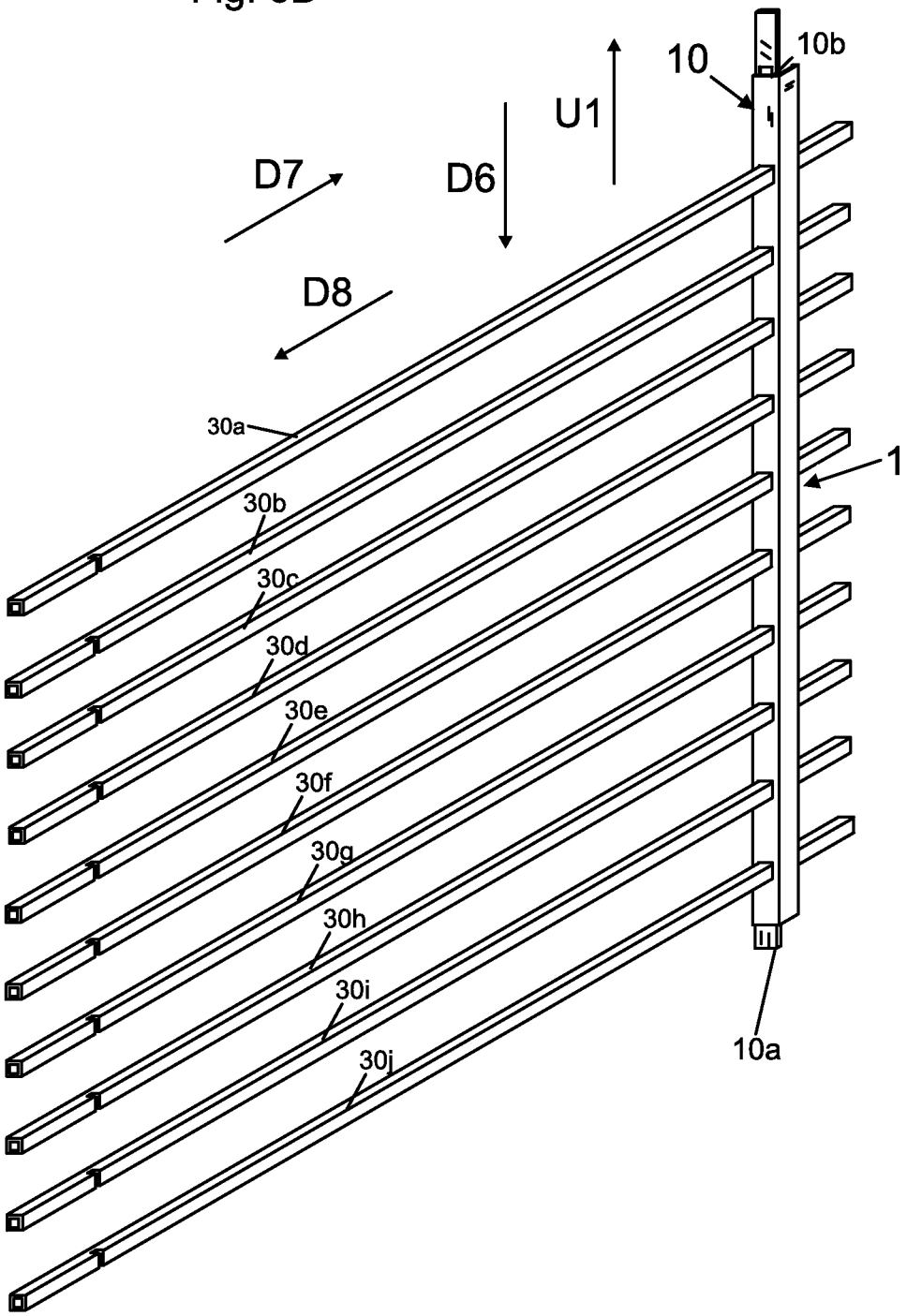
FIG. 6B shows a top, rear, and left side view of a plurality of pickets identical to the picket of FIG. 3A and a bottom, rear, and right side view of the rail of FIG. 1A, and the locking strip of FIG. 2A inserted into the rail, and with the locking strip in a second state, and with the plurality of pickets inserted into the rail.

FIG. 6A shows a top, rear, and left side view of the plurality of pickets 30*a*-*j*, each identical to the picket 30 of FIG. 3A and a bottom, rear, and right side view of the rail 1 of FIG. 1A, with the locking strip 10 inserted into the rail 1, and the locking strip in a first state. FIG. 6B shows a top, rear, and left side view of a plurality of pickets 30*a*-*j*, each identical to the picket 30 of FIG. 3A and a bottom, rear, and right side view of the rail 1 of FIG. 1A, and the locking strip 10 of FIG. 2A inserted into the rail 1, and with the locking strip 10 in a second state, and with the plurality of pickets 30*a*-*j* inserted into the rail 1. In the second state, as in FIG. 5D, the locking strip 10 has been slid up in the direction U1, so that the pickets 30*a*-*j* cannot be moved out of the rail 1 in the directions D7 or D8, due to portion 28*a* of opening 20*a* and analogous portions or openings 20*b*-20*k*, which sit in slots 40*a*-40*j*, shown in FIG. 6A (each of which may be identical or analogous to slot 40 of picket 30).

Figure 7:
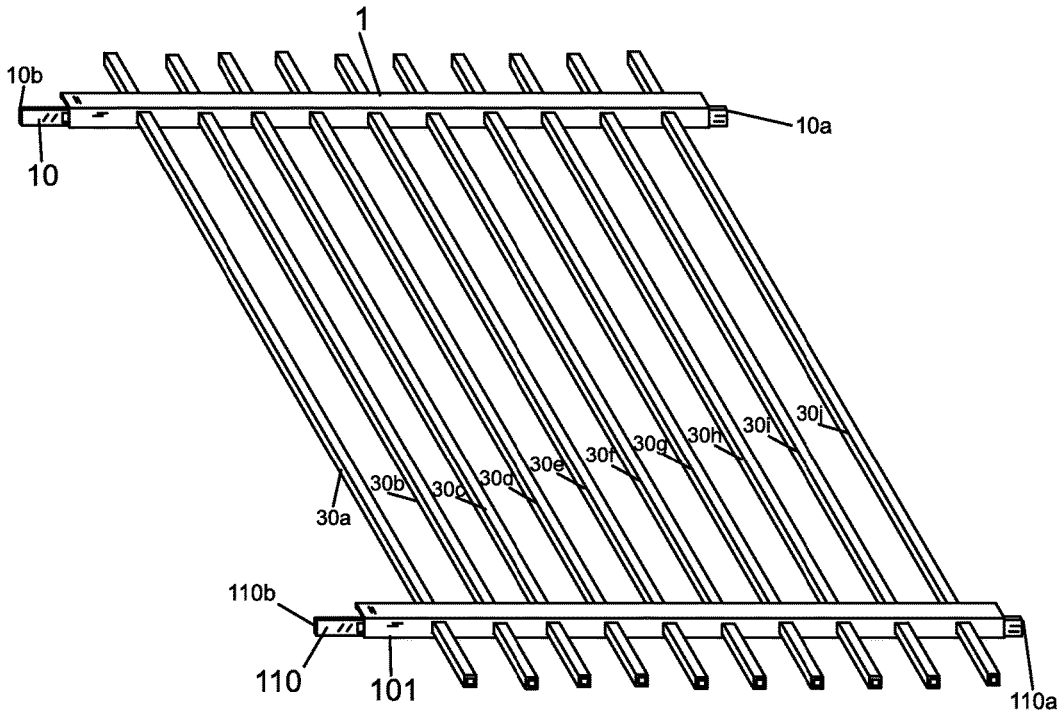
FIG. 7 shows a perspective view of the plurality of pickets shown in FIG. 6B connected to the rail of FIG. 1A, and an identical rail to form a fence section.
Figure 8A:
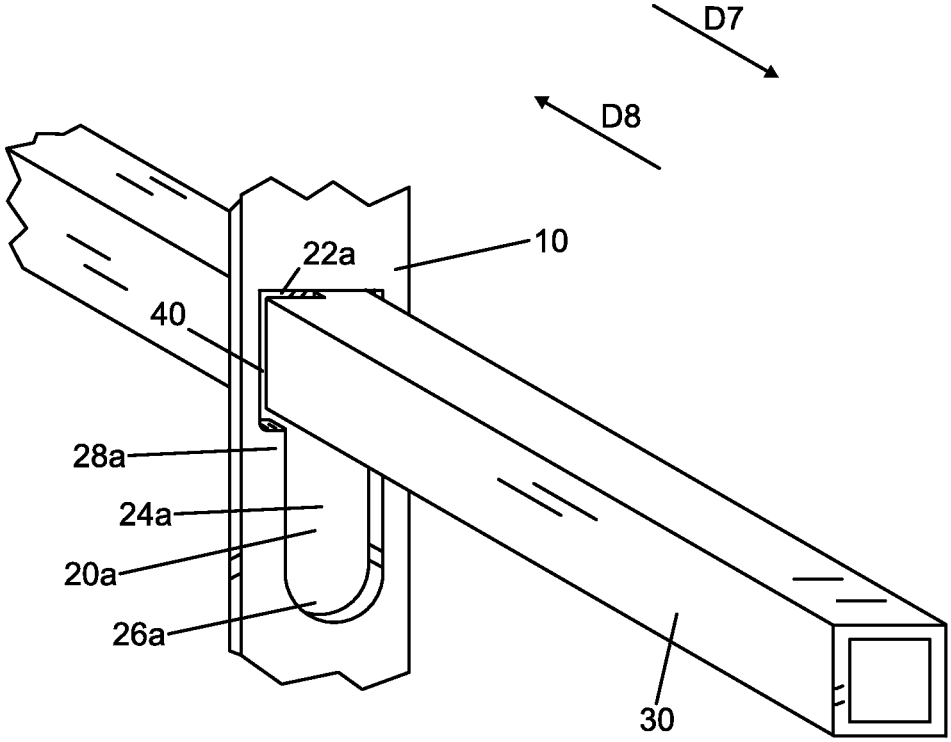
FIG. 8A shows a top, rear, and left side closeup view of a picket of FIG. 3A inserted into a locking strip of FIG. 2A, with the locking strip in a first state.

FIG. 7 shows a perspective view of the plurality of pickets 30*a*-*j* shown in FIG. 6B connected to the rail 1 of FIG. 1A, and an identical rail 101 to form a fence section. The locking strip 10 is shown inserted into the rail 1 and in a locked position in FIG. 7, as in FIG. 6B. A locking strip 110, identical to the locking strip 10, is shown inserted into the rail 101 in FIG. 7, in a manner similar to or identical to the manner in which locking strip 10 is inserted into rail 1. The ends of the pickets 30*a-j* near slots 42*a-j* shown in FIG. 6A are inserted into opening of rail 101 in a manner similar or identical to the manner in which ends of pickets 30*a-j* near slots 40*a-j* are inserted into openings of rail 1. After the particular end of pickets 30*a-j* is placed through the particular opening of rail 1 or 101 and through locking strip 10 or 110, similar or identical to as shown in FIG. 8A, then the locking strip 10 or 110 is slid into a locking position similar or identical to that shown in FIG. 8B. In this manner the pickets 30*a-j* shown in FIG. 7 are locked into position with respect to the rails 1 and 101 by use of locking strips 10 and 110.

FIG. 8A shows a top, rear, and left side closeup view of the picket 30 of FIG. 3A inserted into the locking strip 10 of FIG. 2A, with the locking strip 10 in a first state, such that the picket 30 goes through the portion 22*a* of the opening 20*a*. In the state of FIG. 7A, the picket 30 can be removed from the locking strip 10 because the opening 22*a* is large enough to allow the picket 30 to be removed in the directions D7 or D8. This also occurs in the configuration of FIG. 6A, since the openings 8*a*-8*j* of rail 1 are also large enough to allow movement of the pickets 30*a*-30*j*.

Figure 8B:
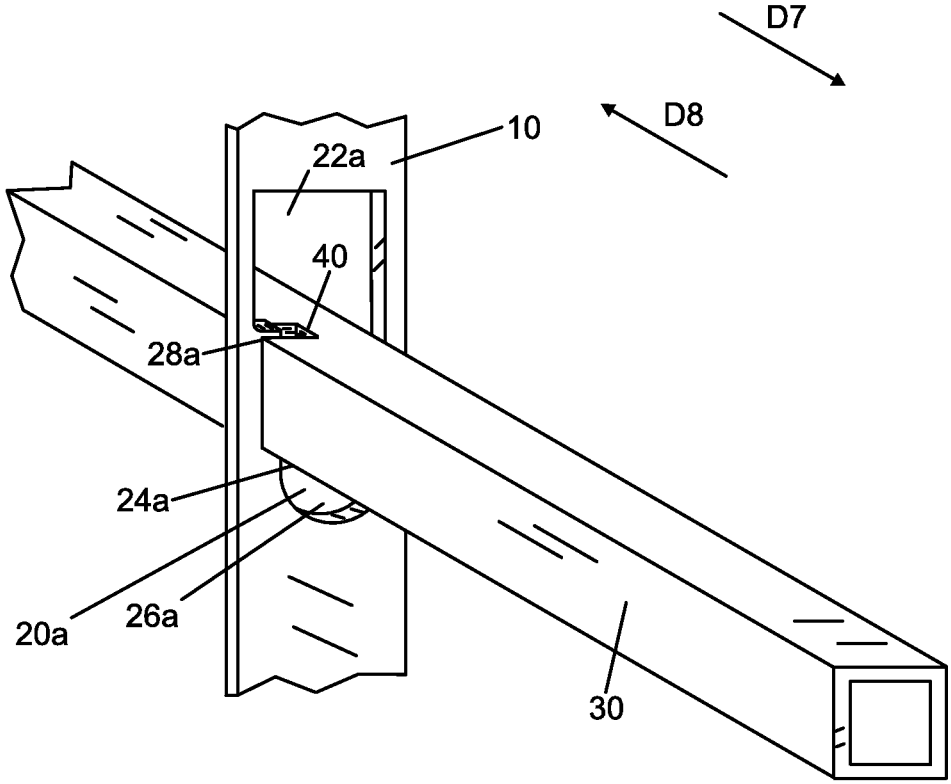
FIG. 8B shows a top, rear, and left side closeup view of a picket of FIG. 3A inserted into a locking strip of FIG. 2A, with the locking strip in a second state.

FIG. 8B shows a top, rear, and left side closeup view of a picket 30 of FIG. 3A inserted into the locking strip 10, with the locking strip 10 in a second state, in which the portion 28*a* of the locking strip 10 is inside of the slot 40. The portion 28*a* prevents the picket 30 from moving in the directions D7 and/or D8 in the configuration of FIG. 8B. This also occurs for the pickets 30*a*-30*j* in the configuration of FIG. 6B, i.e. pickets 30*a*-30*j* cannot move in the directions D7 and/or D8 due to portions analogous to portion 28*a* in slots 40*a*-40*j*, unless the locking strip 10 is slid back down in the direction D6.

One or more rails, locking strips, and pickets, identical or analogous to rail 1, locking strip 10, and picket 30 may be used in a method for assembling fence, railing, window guards and or any other structure constructed using horizontal and vertical members, in accordance with one or more embodiments of the present invention.

The inner rails or protrusions 6*c*, 6*a*, 2*c*, and 2*a*, serve to strengthen the rail 1. The inner rails 6*c* and 2*c* define a channel and/or cavity along with wall 4 for locking strip 10 to pass through. through to secure one or more vertical pickets, such as 30*a-j* and one or more horizontal rails, which may be identical or analogous to rail 1, creating a finished product.

The locking strip will be specifically designed with an opening to allow the vertical picket to slide through and an adjacent lock feature to secure the vertical pickets and horizontal rails into place creating a finished product when engaged.

The locking strip has a depth L6, shown in FIG. 2C which may be about one eight of an inch and which is less than a channel width L5 shown in FIG. 1F, or distance between the wall 4 and the inner rails 2*c* and 6*c*; and this allows the locking strip 10 to be inserted into the channel between wall 4 and the combination of inner rails 6*c* and 2*c*, so that the locking strip 10 slides on the rails 6*c* and 2*c* as shown by FIG. 4B. The locking strip 10 has an overall width W7 shown in FIG. 2C which may be about one and three eighths inches which is slightly less than the distance between opposing walls 2 and 6 shown in FIG. 4B, to allow the locking strip 10 to slide in the channel between wall 4 and the combination or inner rails 2*c* and 6*c*, which being held up by the inner rails 2*c* and 6*c*.

In operation, in at least one embodiment, a plurality of horizontal rails, identical to rail 1, may be placed onto a flat surface, and a plurality of locking strips 10 may be slid up into the horizontal rail rib/cavity area or channel between wall 4 and inner rails 2*c* and 6*c* so that the holes 8*a*-8*j* on the horizontal metal rail 1 line up with the holes 20*j-a* in the locking strip 10 as shown in FIG. 5C. A plurality of sets of pickets 30*a-j* may then be slid through a plurality of sets of holes 8*a*-8*j* in the plurality of horizontal metal rails identical to rail 1 and also the holes 20*j-a*, in the plurality of locking strips. Each of the plurality of locking strips, identical to 10, may be engaged by pulling it horizontally (shown as the direction U1 of FIG. 5D), to lock the plurality of sets of vertical pickets 30*a-j* with the plurality of horizontal rails creating a finished product. Note that FIG. 6A shows rail 1 as vertical, but rail 1 would typically be horizontal, and the pickets 30*a-j* would be perpendicular to the rail 1, and typically pickets 30*a-j* would be vertical.

Figure 9A:
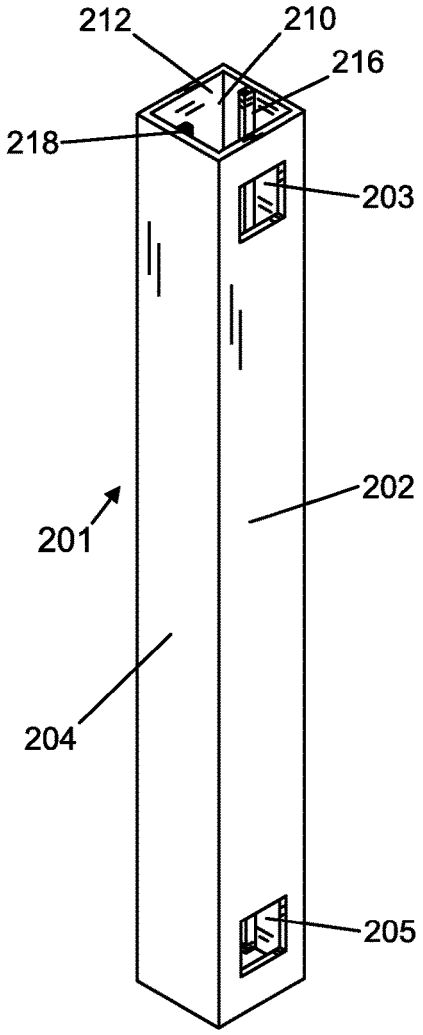
FIG. 9A shows a top, front, and right side perspective view of a post for use with one or more embodiments of the present invention.
Figure 9B:
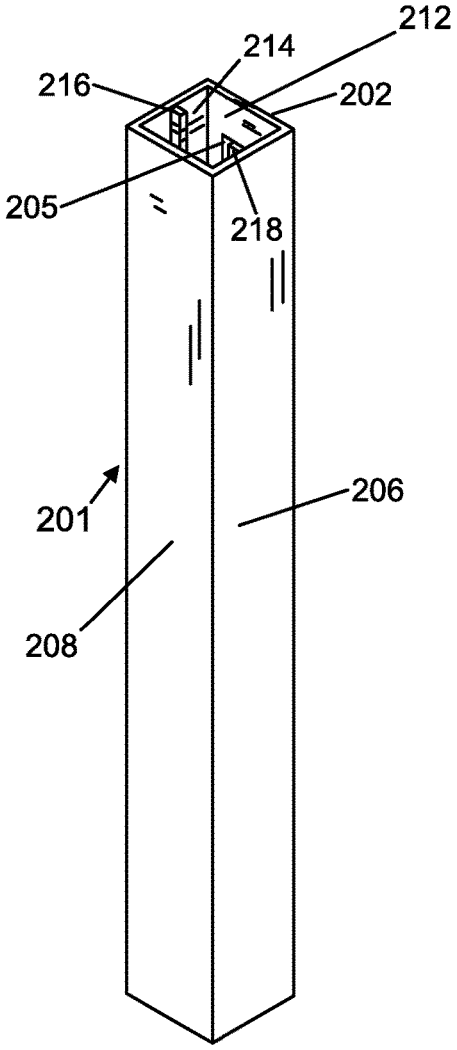
FIG. 9B shows a bottom, rear, and left side perspective view of the post of FIG. 9A.

FIG. 9A shows a top, front, and right side perspective view of a post 201 for use with one or more embodiments of the present invention. FIG. 9B shows a bottom, rear, and left side perspective view of the post 201. The post 201 may be made of a hard material such as steel, aluminum, plastic, or composites. The post 201 includes walls 202, 204, 206, and 208. The post 201 has an opening 210 and an opposing opening 214, both of which lead to inner chamber 212. The post 201 has openings 203 and 205, which may be square or substantially square and which lead to inner chamber 212. The post 201 has ribs, protrusions or flanges 216 and 218.

Figure 10A:
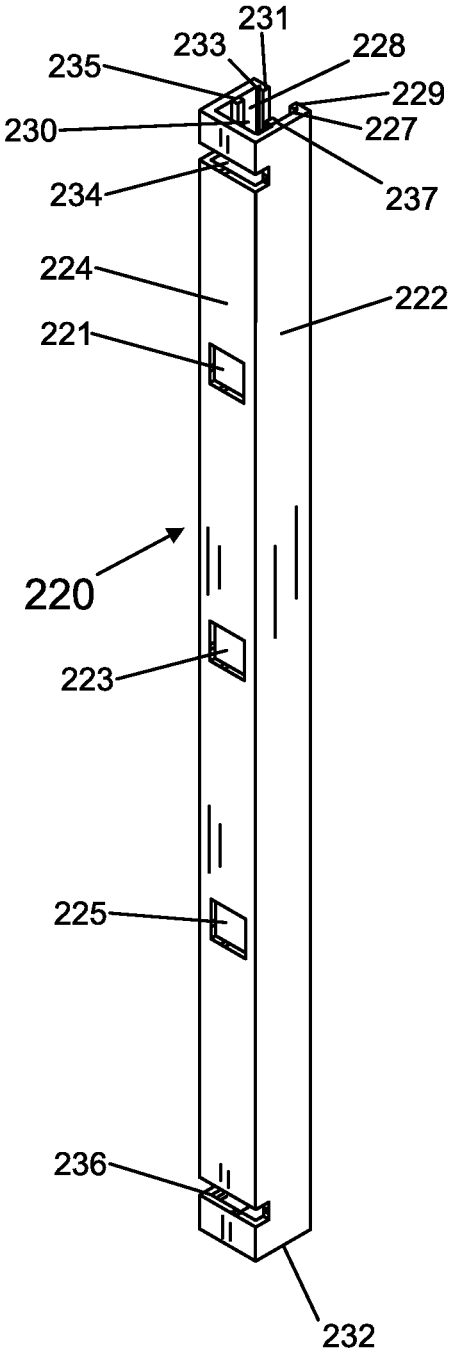
FIG. 10A shows a top, front, and right side perspective view of another rail for use with one or more embodiments of the present invention.
Figure 10B:
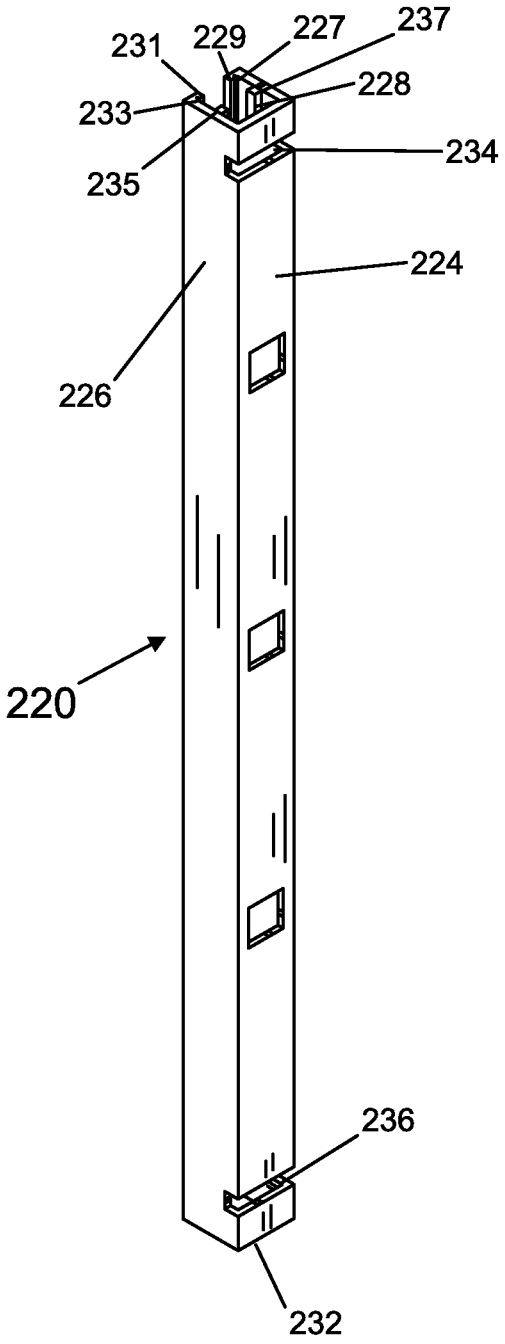
FIG. 10B shows a top, front, and left side perspective view of the rail of FIG. 10A.
Figure 10C:
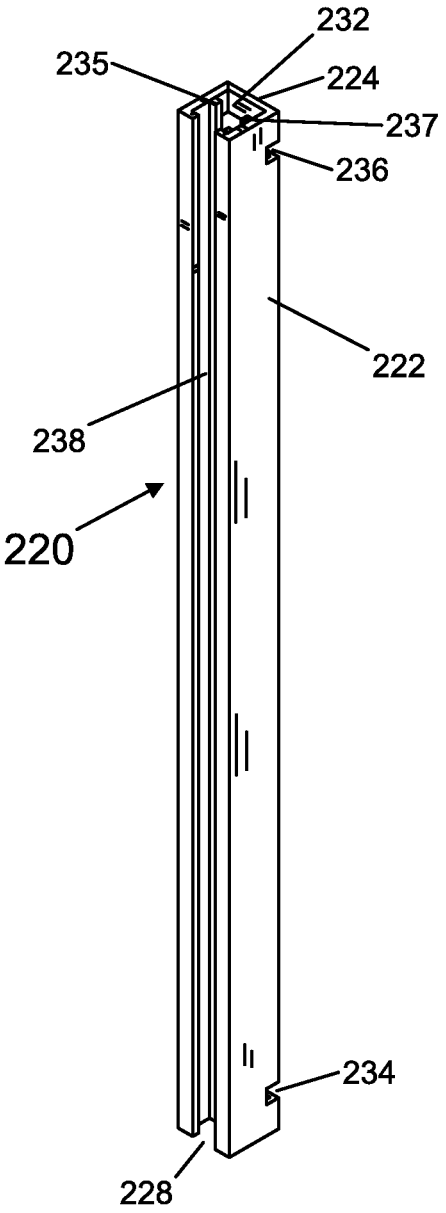
FIG. 10C shows a bottom, rear, and right side perspective view of the rail of FIG. 10A.
Figure 10D:
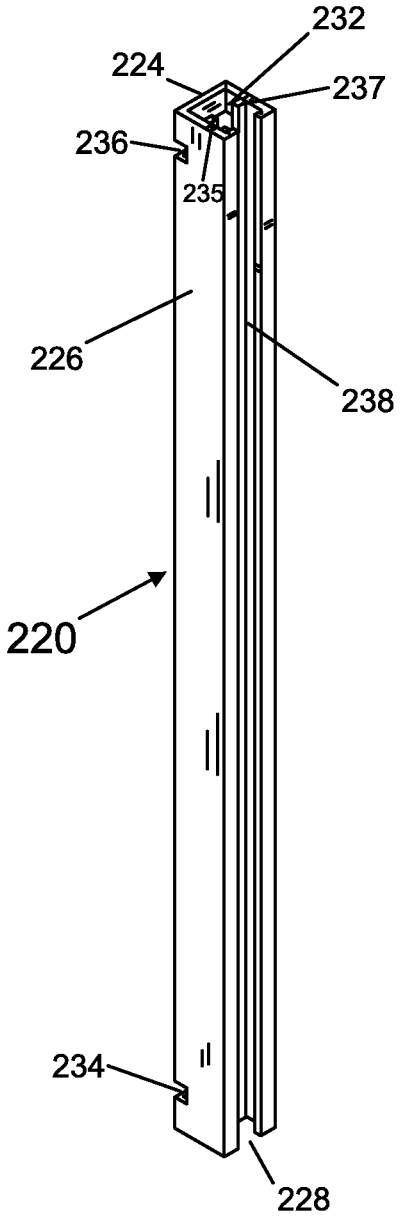
FIG. 10D shows a bottom, rear, and left side perspective view of the rail of FIG. 10A.

FIG. 10A shows a top, front, and right side perspective view of a rail 220 for use with one or more embodiments of the present invention. FIG. 10B shows a top, front, and left side perspective view of the rail 220. FIG. 10C shows a bottom, rear, and right side perspective view of the rail 220. FIG. 10D shows a bottom, rear, and left side perspective view of the rail 220. Referring to FIGS. 10A-D, the rail 220 includes walls 222, 224, and 226. The rail 220 has an opening 228 and an opposing opening 232, both of which lead to inner chamber 230. The rail 220 has slots 234 and 236. The rail 220 further has openings 221, 223, and 225, which may be square or substantially square. The rail 220 further includes inner rails, flanges, ribs, or protrusions 229 and 231, and grooves or indentations 227 and 233. The rail 220 may be made of a hard material such as steel, aluminum, plastic or composites. The rail 220 may be elongated and may have a slot 238, opposite wall 224 and running the length of the rail 220.

The rail 220 also includes the protrusion or ribs 235 and 237. The rail 220 may be elongated with a length substantially greater than its width. The ribs 235 and 237 may run the entire length of the rail 220.

Figure 11A:
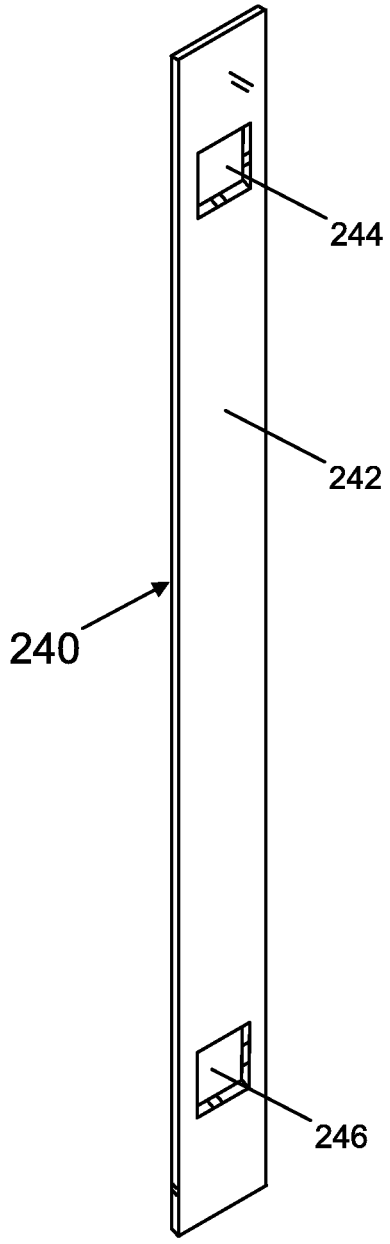
FIG. 11A shows a top, front, and left side perspective view of another locking strip for use with one or more embodiments of the present invention.
Figure 11B:
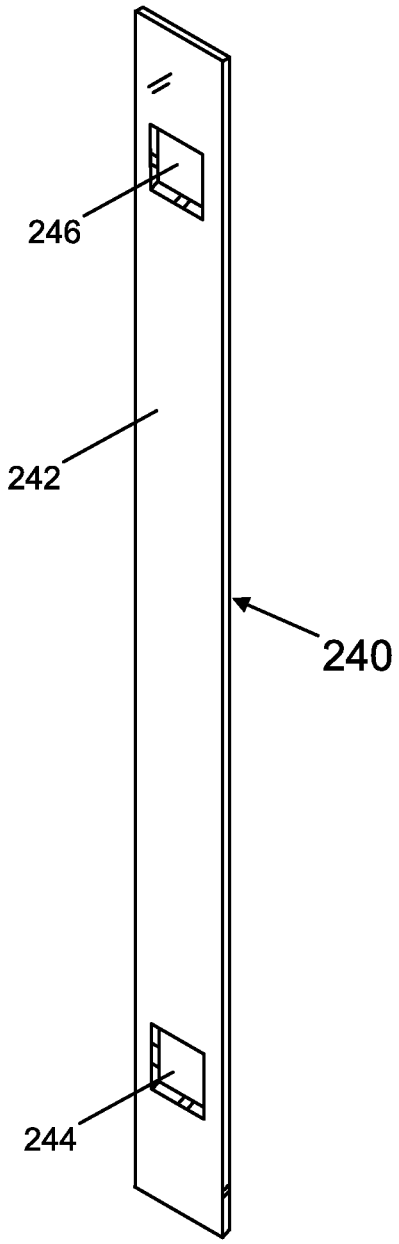
FIG. 11B shows a bottom, rear, and right side perspective view of the locking strip of FIG. 11A.

FIG. 11A shows a top, front, and left side perspective view of a locking strip 240 for use with one or more embodiments of the present invention. FIG. 11B shows a bottom, rear, and right side perspective view of the locking strip 240. The locking strip 240 may be made of a hard metal, such as steel, or a hard plastic material. The locking strip 240 may include openings 244 and 246 which may be square or substantially square. The locking strip 240 may include a body portion 242.

FIG. 12 shows a perspective view of the rail 220 of FIGS. 10A-10D along with an identical rail 220*a*; and the locking strip 260 of FIGS. 11A-11B along with an identical locking strip 260*a*, with the locking strips 260 and 260*a* shown separated from the rails 220 and 220*a*, respectively. The locking strip 260*a* may include openings 264*a*, 266*a*, and 268*a* and a body portion 262*a* analogous to openings 264, 266, 268, and body portion 262 of the locking strip 260.

Figure 13:
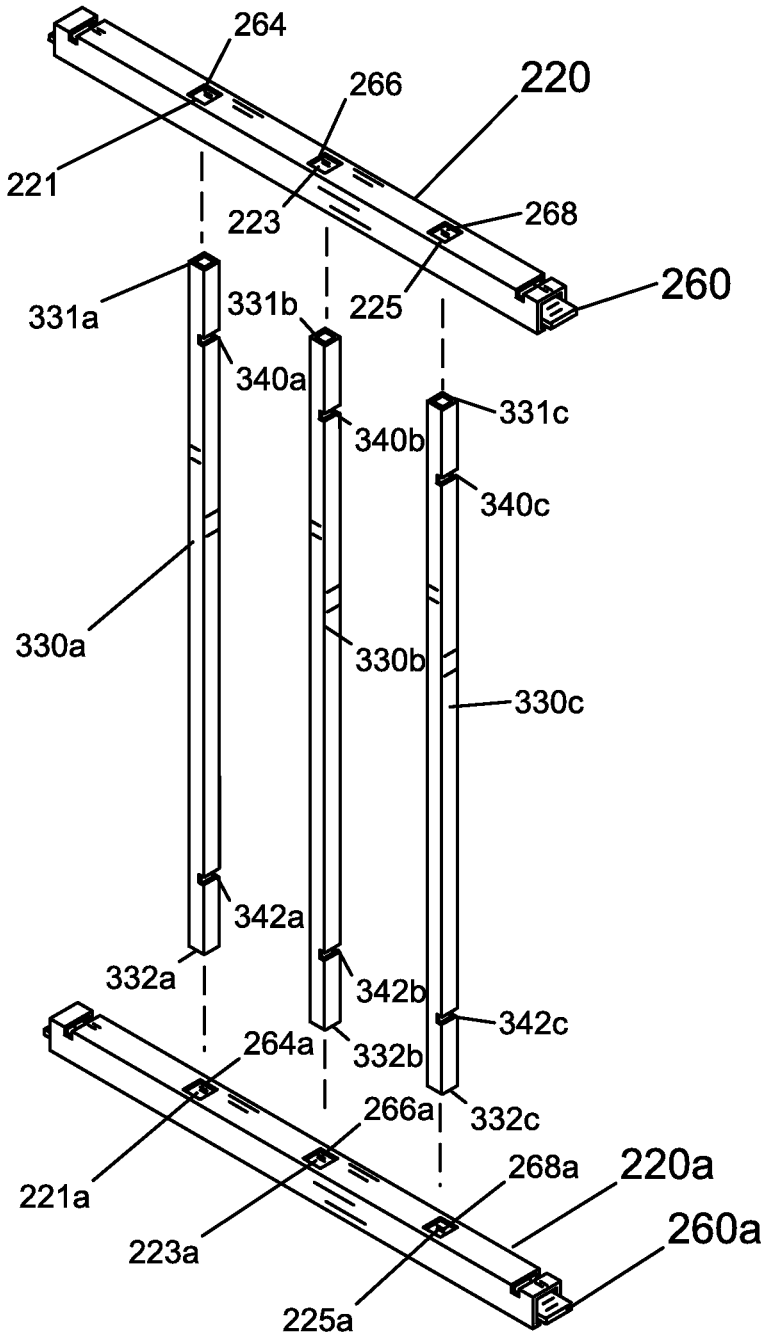
FIG. 13 shows a perspective view of the rails of FIG. 12 and the locking strips of FIG. 12 with each locking strip of FIG. 12 inserted into a rail of FIG. 12, and along with a plurality of pickets, which are shown separated from the rails and locking strips.

FIG. 13 shows a perspective view of the rails 220 and 220*a* and the locking strips 260 and 260*a* with locking strips 260 and 260*a* inserted into rails 220 and 220*a*, respectively, and along with a pickets 330*a*, 330*b*, and 330*c*, which are shown separated from the rails 220 and 220*a* and locking strips 260 and 260*a*. Each of the pickets 330*a-c* may be substantially identical to the picket 30 of FIGS. 3A-3B, except that the pickets 330*a-c* may be a different length and/or width from the picket 30 of FIGS. 3A-3B. The pickets 330*a-c* may include slots 340*a-c*, slots 342*a-c*, ends 331*a-c*, and ends 332*a-c*, respectively.

Figure 14A:
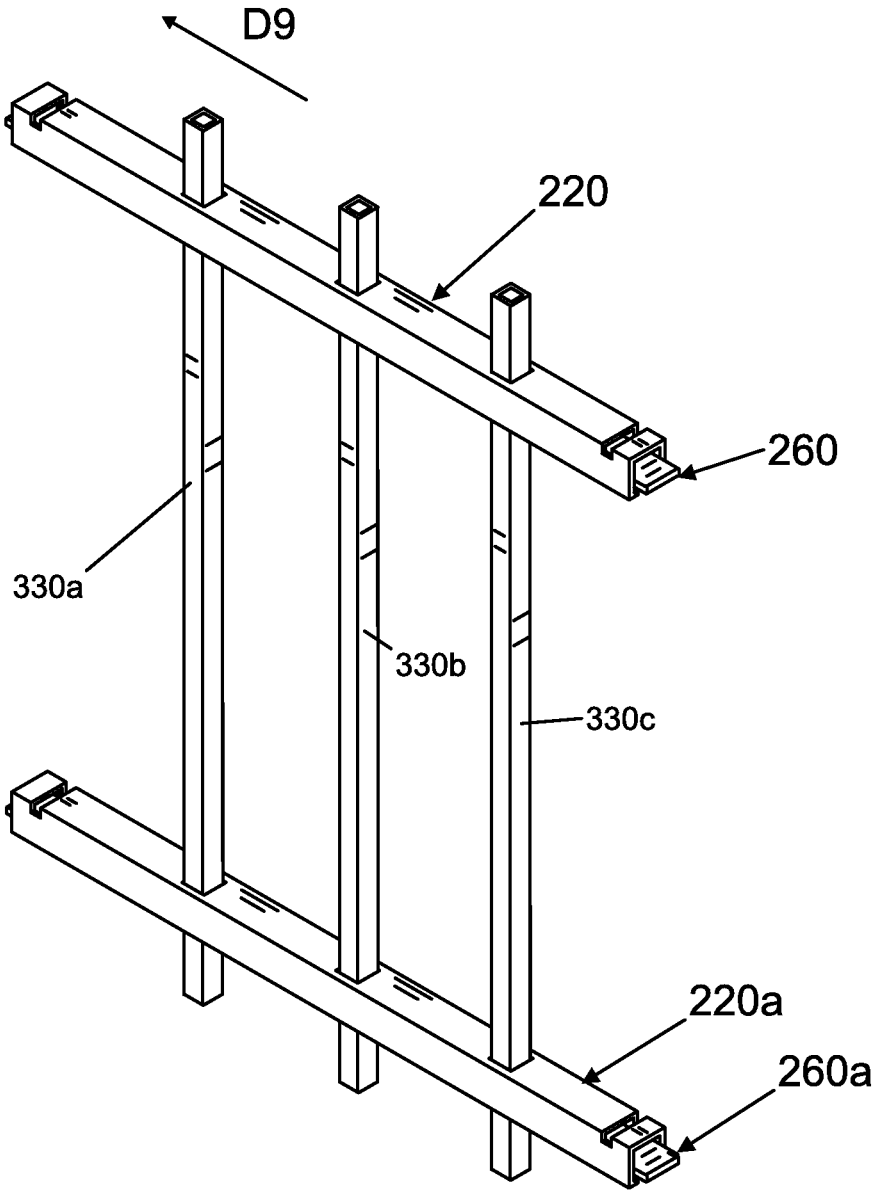
FIG. 14A shows a perspective view of the pickets of FIG. 13 inserted into the rails of FIG. 13, and each of the locking strips of FIG. 13 inserted into one of the rails, with the locking strips shown in a non locked or open state.
Figure 14B:
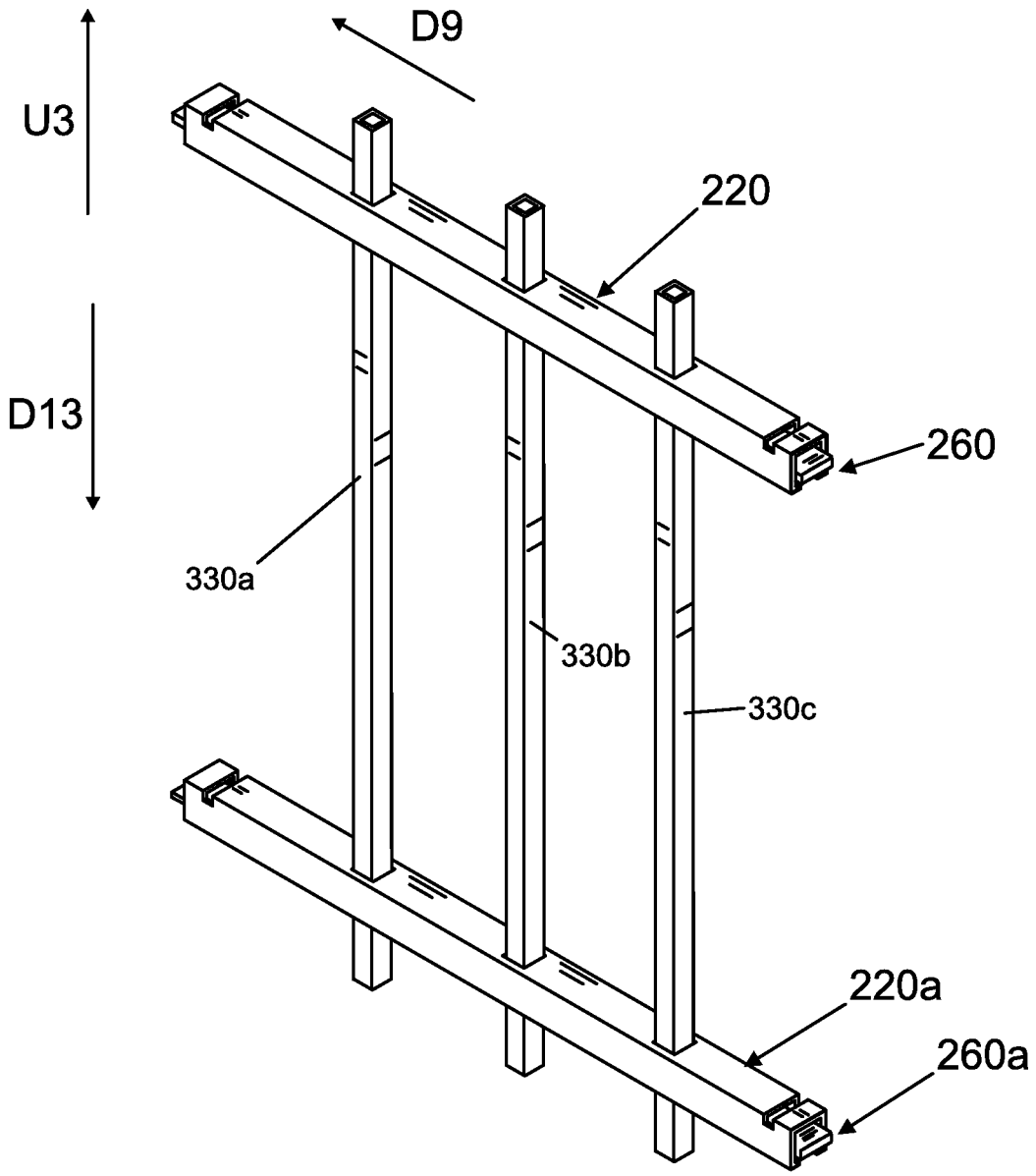
FIG. 14B shows a perspective view of the pickets of FIG. 13 inserted into the rails of FIG. 13, and each of the locking strips of FIG. 13 inserted into one of the rails, with the locking strips shown in a locked state.

FIG. 14A shows a perspective view of the pickets 330*a-c* of FIG. 13 inserted into the rails 220 and 220*a* of FIG. 13, and with the locking strips 260 and 260*a* inserted into the rails 220 and 220*a*, respectively, with the locking strips 260 and 260*a* shown in a non locked or open state. FIG. 14B shows a perspective view of the pickets 330*a-c* of FIG. 13 inserted into the rails 220 and 220*a* of FIG. 13, and the locking strips 260 and 260*a* inserted the rails 220 and 220*a*, respectively, with the locking strips 260 and 260*a* shown in a locked state.

Figure 15A:
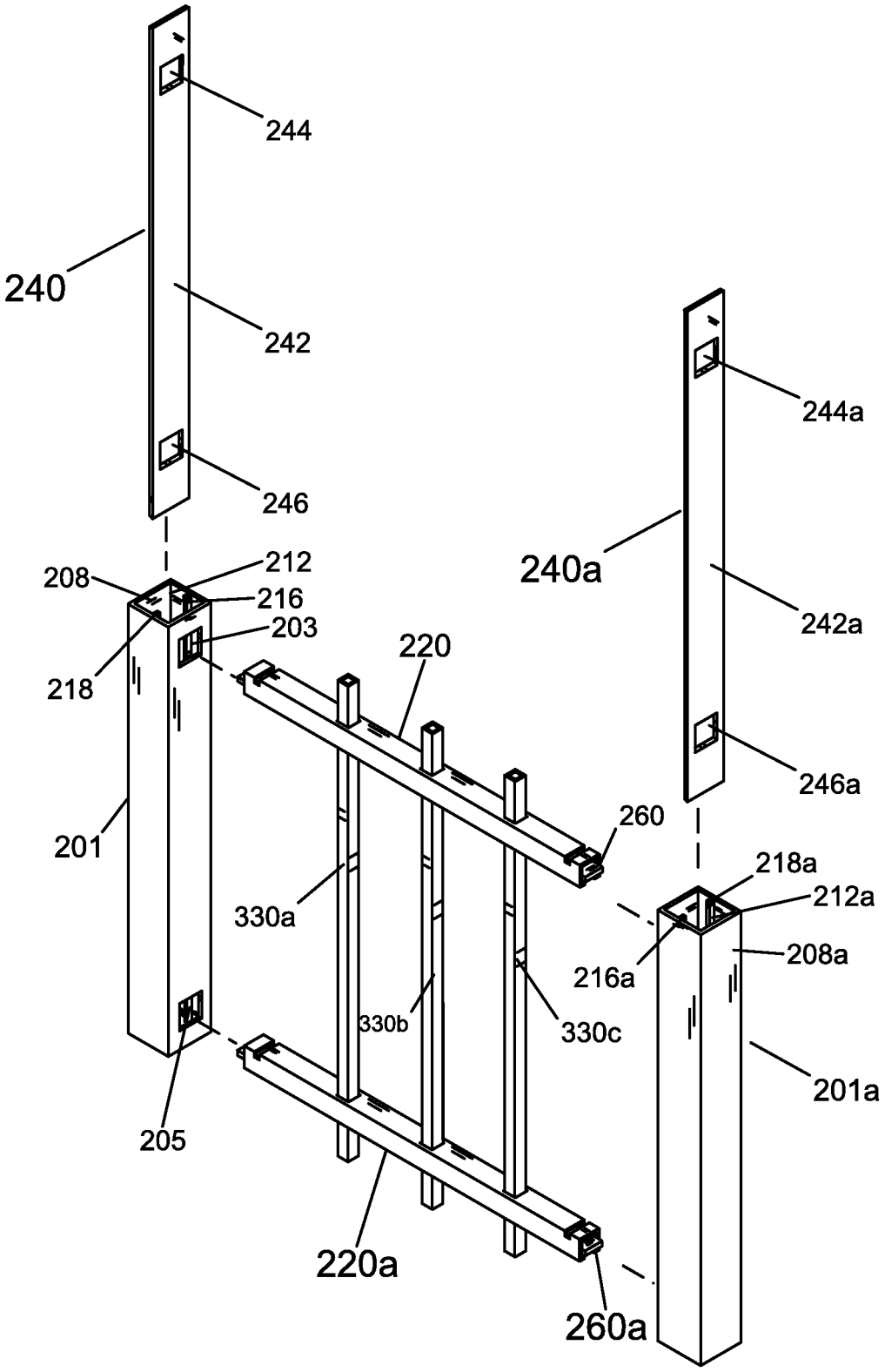
FIG. 15A shows a perspective view of the pickets of FIG. 13 inserted into the rails of FIG. 13, and each of the locking strips of FIG. 13 inserted into one of the rails, with the locking strips of FIG. 14B shown in a locked state, and along with the post of FIGS. 9A-9B and an identical post, and the locking strip of FIG. 11A-11B and an identical locking strip, wherein the locking strips of FIGS. 11A-B are not inserted into a post.

FIG. 15A shows a perspective view of the pickets 330*a-c* of FIG. 13 inserted into the rails 220 and 220*a* of FIG. 13, the locking strips 260 and 260*a* inserted into the rails 220 and 220*a*, with the locking strips 260 and 260*a* shown in a locked state, and along with the post 201 of FIGS. 9A-9B and an identical post 201*a*, and the locking strip 240 of FIG. 11A-11B and an identical locking strip 240*a*, wherein the locking strips 240 and 240*a* of FIGS. 11A-B are not inserted into a post of posts 201 and 201*a*. The locking strip 240*a* includes openings 244*a* and 246*a*, and body portion 242*a*, analogous to openings 244 and 246, and body portion 242 of locking strip 240.

Figure 15B:
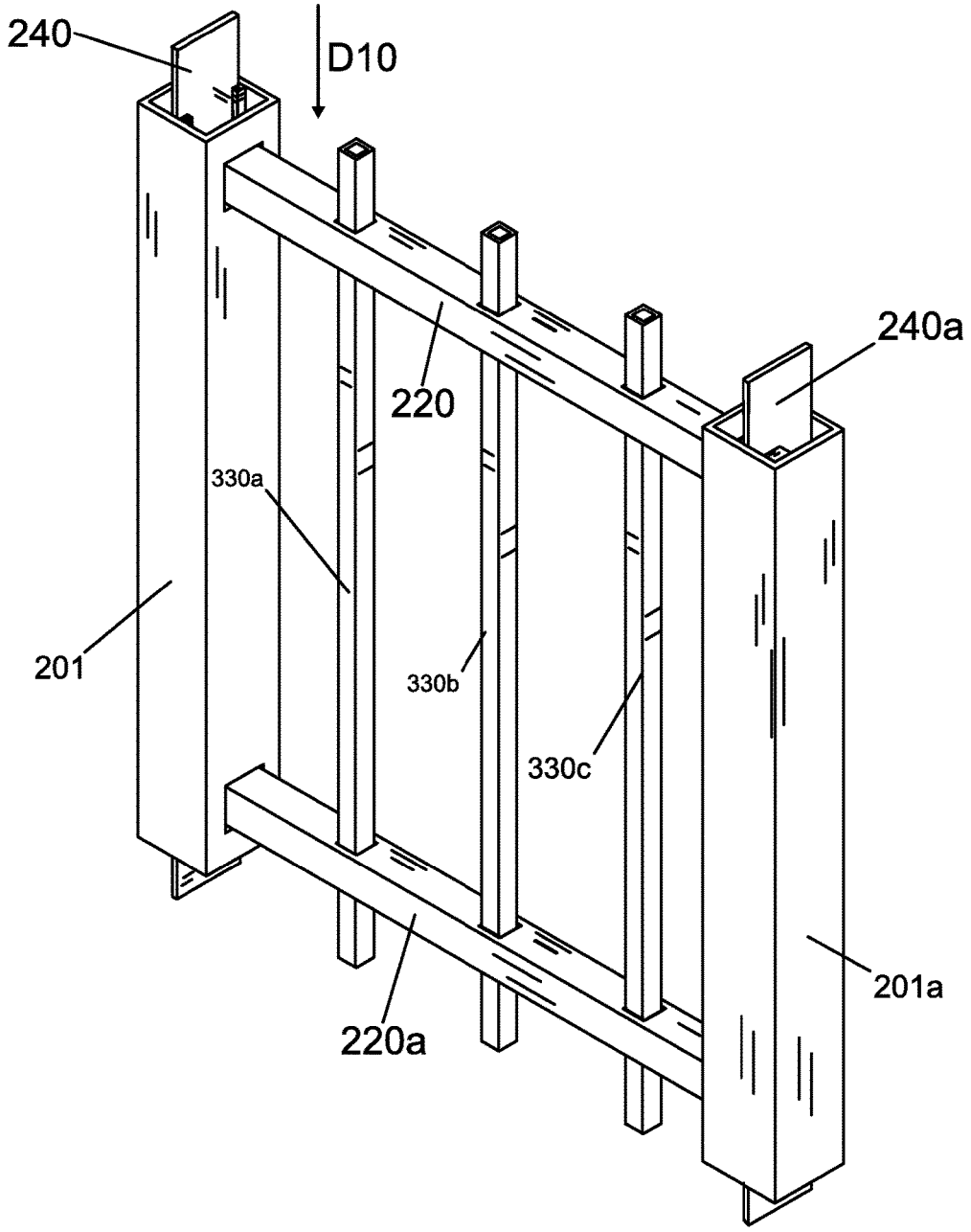
FIG. 15B shows a perspective view of the pickets of FIG. 13 inserted into the rails of FIG. 13, and each of the locking strips of FIG. 13 inserted into one of the rails, with the locking strips of FIG. 14B shown in a locked state, and along with the post of FIGS. 9A-9B and an identical post, and the locking strip of FIG. 11A-11B and an identical locking strip, wherein the locking strips of FIGS. 11A-B are inserted into a post, but are in an open or non locked state.

FIG. 15B shows a perspective view of the pickets 330*a-c* of FIG. 13 inserted into the rails 220 and 220*a* of FIG. 13, and each of the locking strips 260 and 260*a* of FIG. 13 inserted into one of the rails (locking strips 260 and 260*a* not visible in FIG. 15B), with the locking strips of FIG. 14B shown in a locked state, and along with the post 201 of FIGS. 9A-9B and the identical post 201*a*, and the locking strip 240 of FIG. 11A-11B and the identical locking strip 240*a*, wherein the locking strips 240 and 240*a* into posts 201 and 201*a*, respectively, but are in an open or non locked state.

Figure 15C:
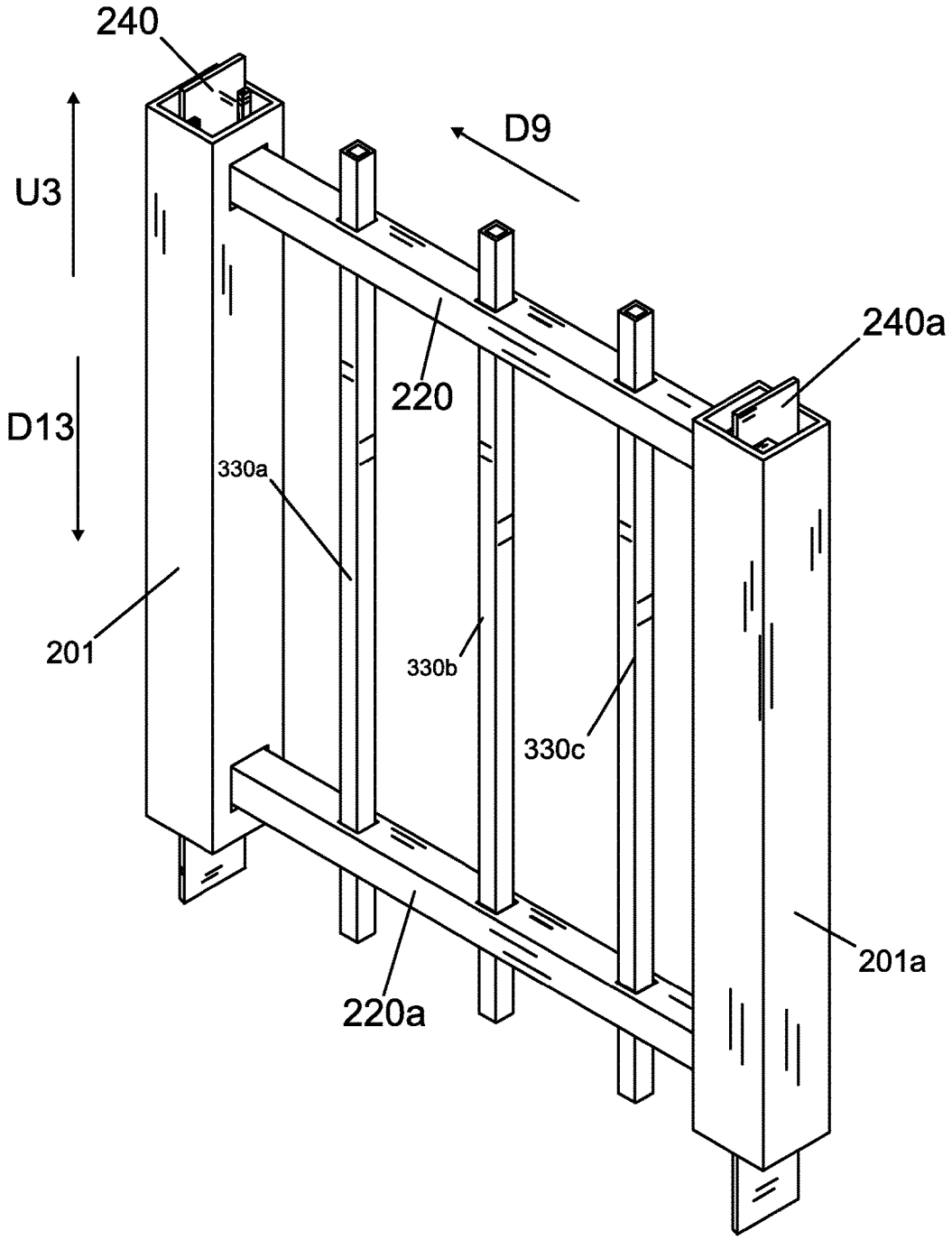
FIG. 15C shows a perspective view of the pickets of FIG. 13 inserted into the rails of FIG. 13, and each of the locking strips of FIG. 13 inserted into one of the rails, with the locking strips of FIG. 14B shown in a locked state, and along with the post of FIGS. 9A-9B and an identical post, and the locking strip of FIG. 11A-11B and an identical locking strip, wherein the locking strips of FIGS. 11A-B are inserted into a post, but are in a locked state.

FIG. 15C shows a perspective view of the pickets 330*a-c* of FIG. 13 inserted into the rails 220 and 220*a* of FIG. 13, and each of the locking strips 260 and 260*a* of FIG. 13 inserted into one of the rails 220 and 220*a* (strips 260 and 260*a* not visible in FIG. 15C), with the locking strips of FIG. 14B in a locked state, and along with the post 201 of FIGS. 9A-9B and the identical post 201*a*, and the locking strip 240 of FIG. 11A-11B and the identical locking strip 240*a*, wherein the locking strips 240 and 240*a* are inserted into posts 201 and 201*a*, but are in a locked state.

Figure 16A:
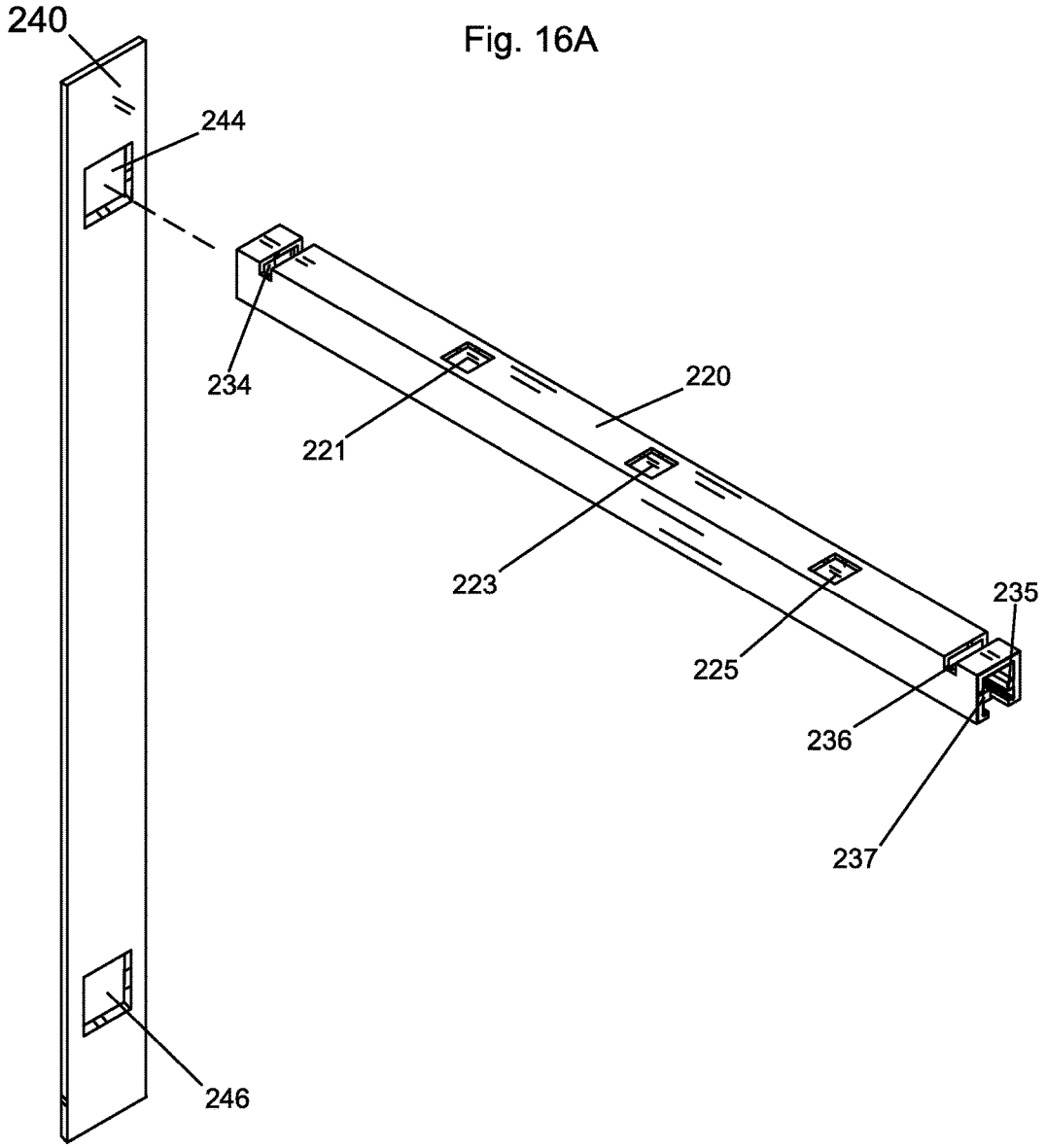
FIG. 16A shows a perspective view of the locking strip of FIGS. 11A-11B and the rail of FIGS. 10A-10B, separate from each other.
Figure 16B:
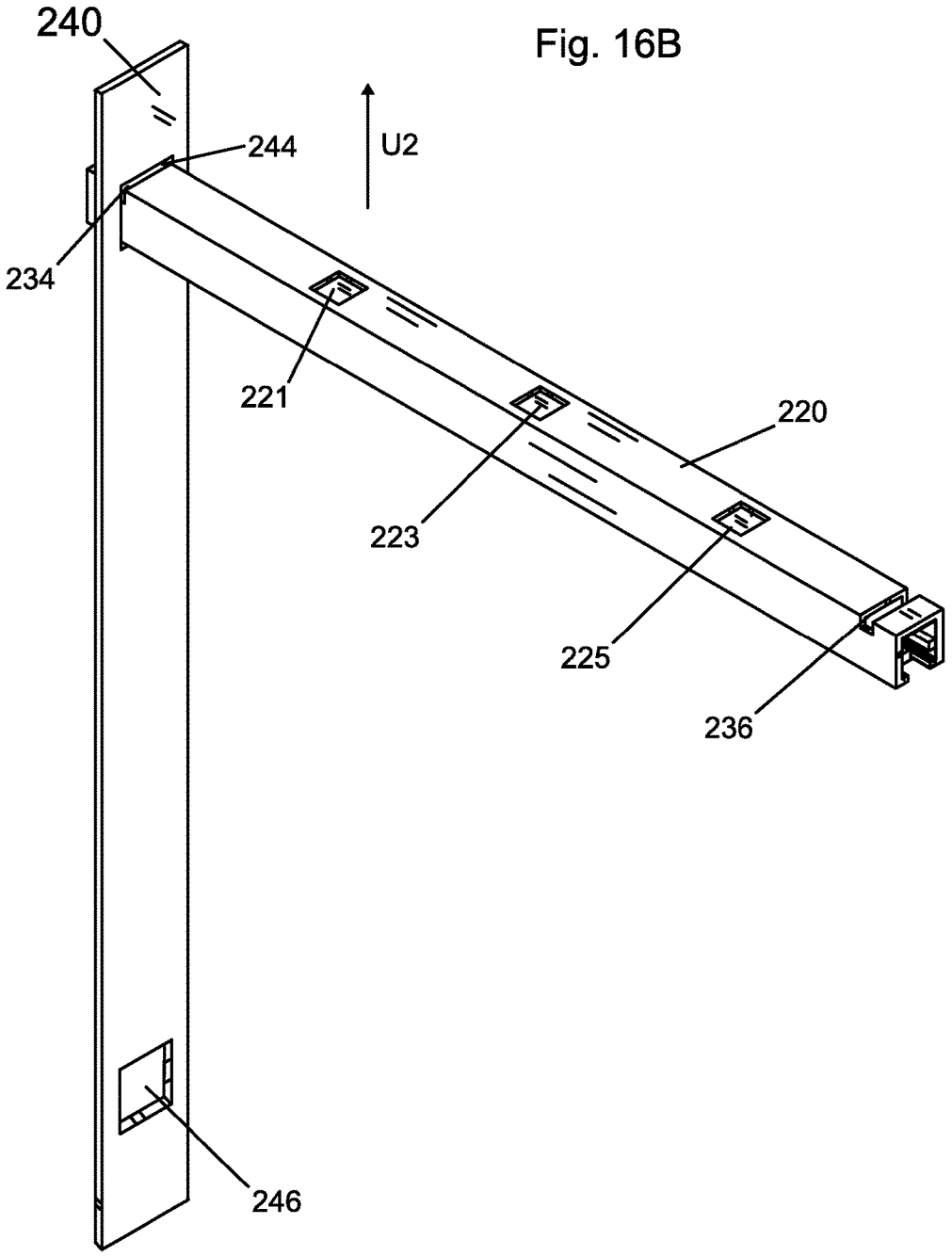
FIG. 16B shows a perspective view of the locking strip of FIGS. 11A-11B and the rail of FIGS. 10A-10B, connected together in a non locked or open state.
Figure 16C:
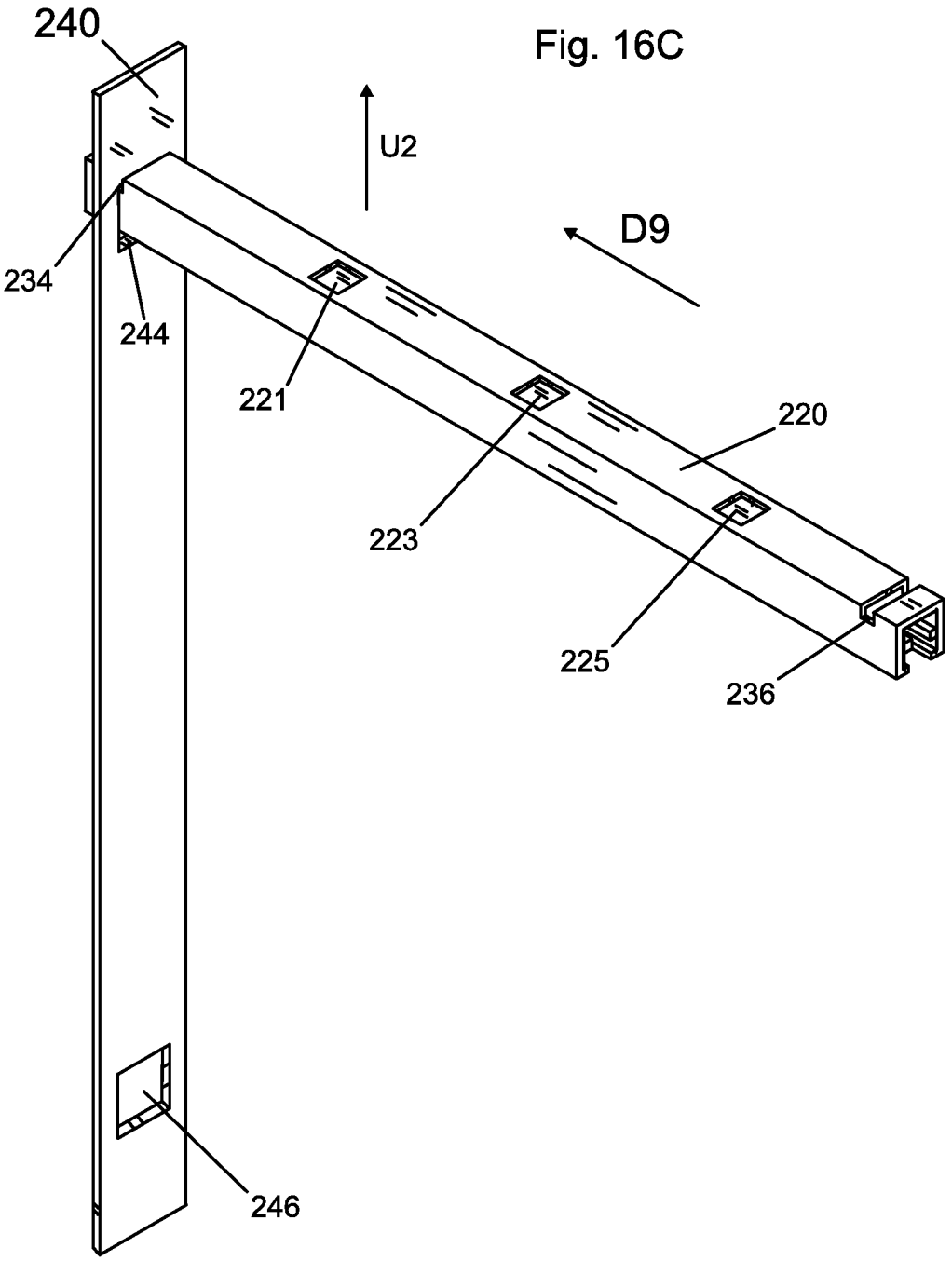
FIG. 16C shows a perspective view of the locking strip of FIGS. 11A-11B and the rail of FIGS. 10A-10B, connected together in a locked state.

FIG. 16A shows a perspective view of the locking strip 240 of FIGS. 11A-11B and the rail 220 of FIGS. 10A-10B, separate from each other. FIG. 16B shows a perspective view of the locking strip 240 of FIGS. 11A-11B and the rail 220 of FIGS. 10A-10B, connected together in a non locked or open state. FIG. 16C shows a perspective view of the locking strip 240 of FIGS. 11A-11B and the rail 220 of FIGS. 10A-10B, connected together in a locked state.

Figure 17A:
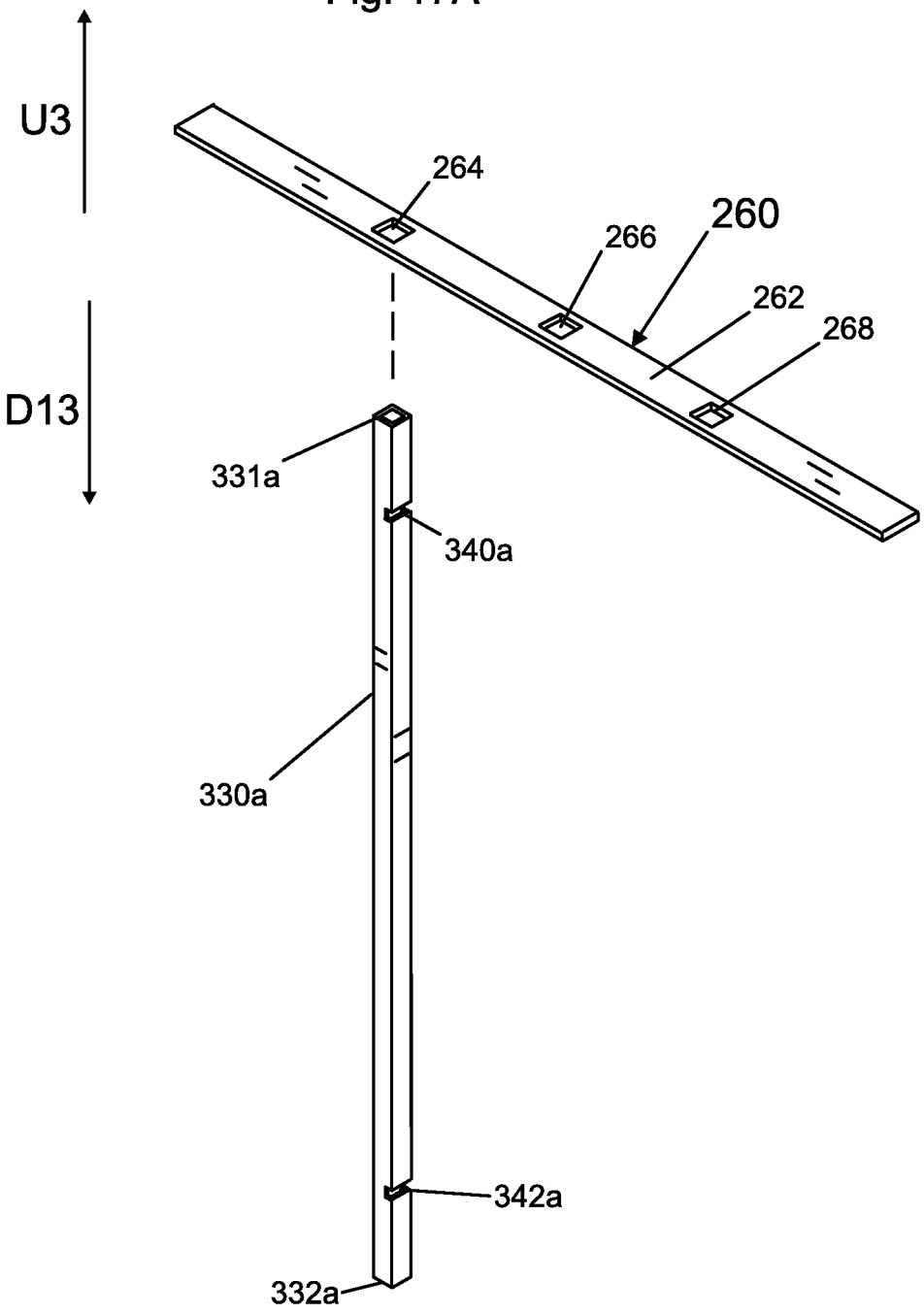
FIG. 17A shows a perspective view of one of the pickets of FIG. 13 and a locking strip of FIG. 12, separate from each other.
Figure 17B:
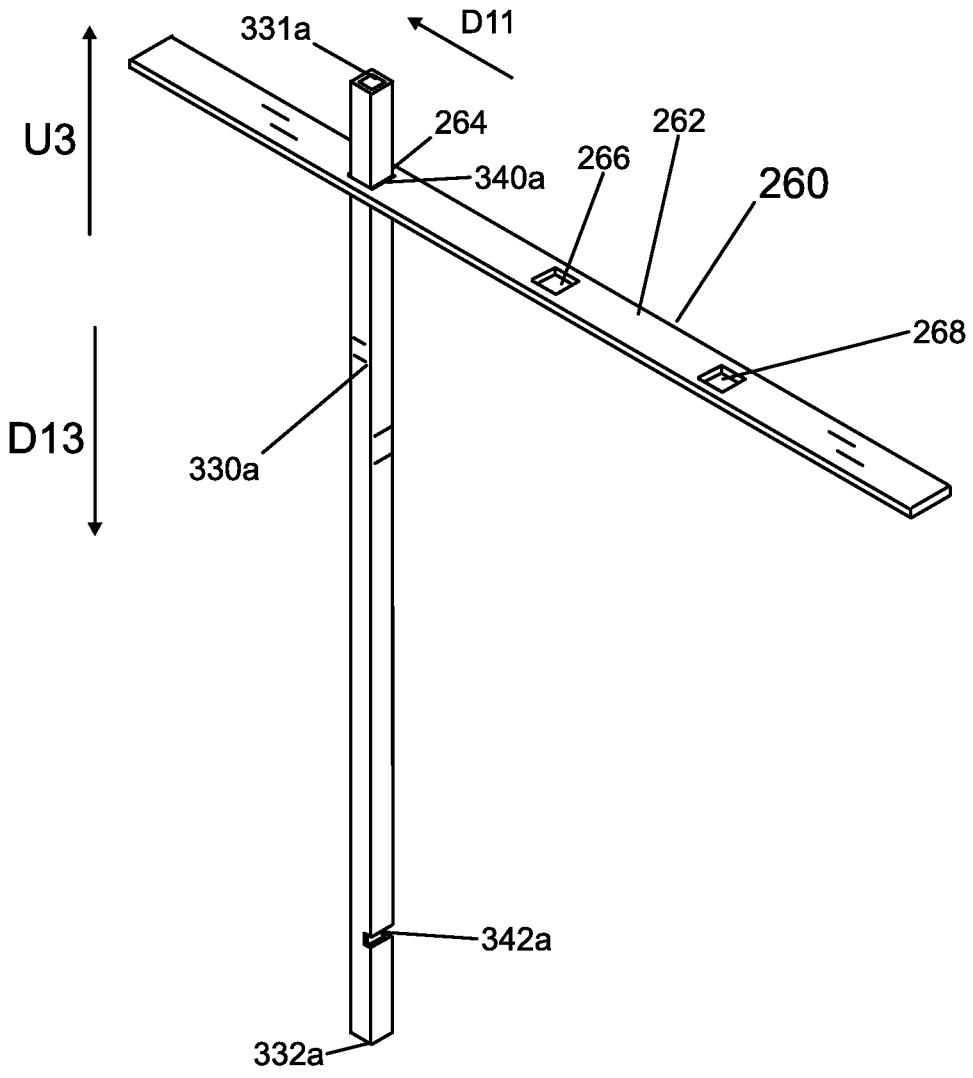
FIG. 17B shows a perspective view of one of the pickets of FIG. 13 and a locking strip of FIG. 12, connected together in a non locked or open state.
Figure 17C:
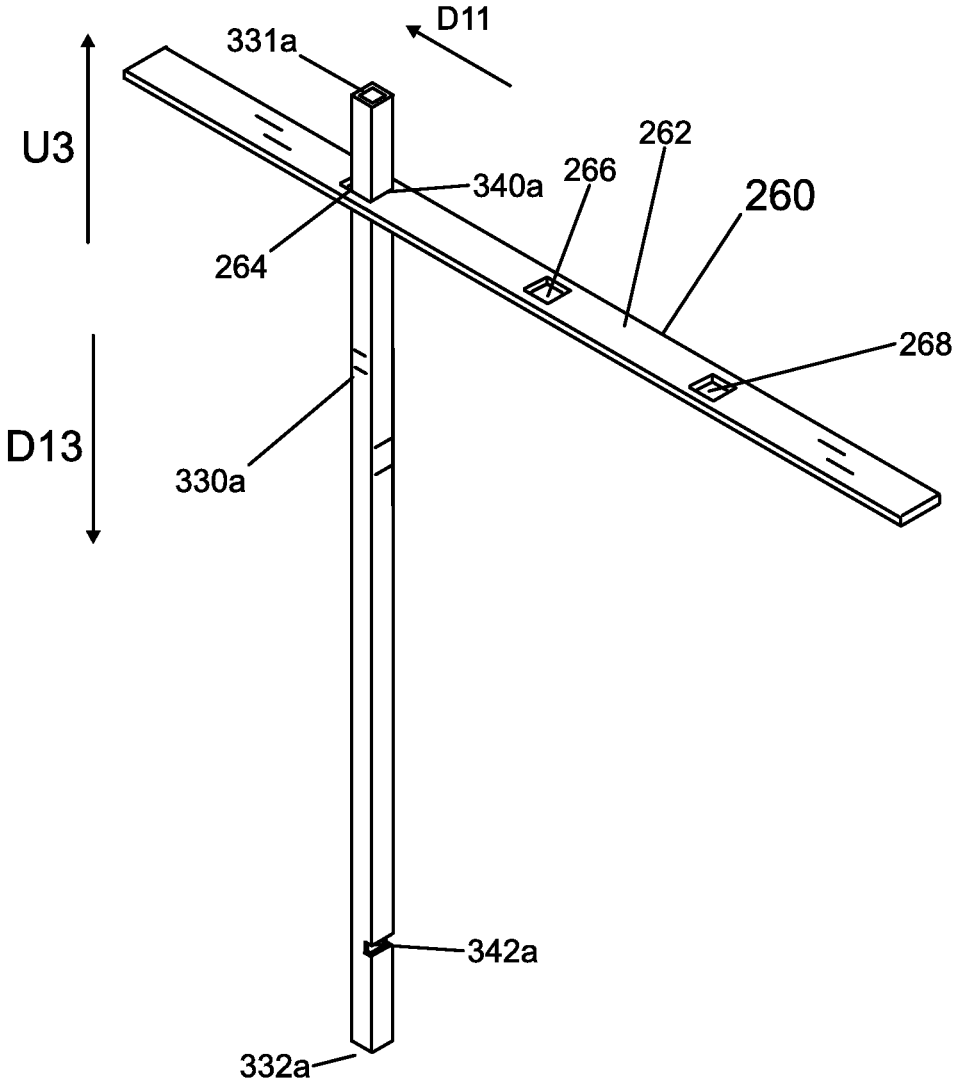
FIG. 17C shows a perspective view of one of the pickets of FIG. 13 and a locking strip of FIG. 12, connected together in a locked state.

FIG. 17A shows a perspective view of picket 330*a* of FIG. 13 and the locking strip 260 of FIG. 12, separate from each other. FIG. 17B shows a perspective view of picket 330*a* of FIG. 13 and a locking strip 260 of FIG. 12, connected together in a non locked or open state. FIG. 17C shows a perspective view of one of picket 220*a* of FIG. 13 and the locking strip 260, connected together in a non locked or open state.

In operation, referring to FIG. 12, an end of locking strip 260 nearest the opening 264 can be inserted into the opening 228 of the rail 220 shown in FIG. 12. The locking strip 260 is inserted into the inner chamber 230 shown by FIGS. 10A-10D, so that the locking strip 260 lies flat, inside the inner chamber 230 on the protrusions or flanges 231 and 229, or on the ribs, protrusions or flanges 237 and 235 shown in FIGS. 10A, 10B, and 12, between the protrusions 231 and 229 (or protrusions 237 and 235) and the wall 224, and so that the openings 264, 266, and 268 of the locking strip 260 are aligned with the openings 225, 223, and 221, respectively, of the rail 220. When the locking strip 260 is inside the inner chamber 230 as described, with the openings 264, 266, and 268 aligned with the openings 225, 223, and 221, the locking strip 260 is in an unlocked state with respect the rail 220. The openings 264, 266, and 268 may be about the same size and shape as the openings 225, 223, and 221, respectively. Although shown as square shaped, the openings 264, 266, 268, 225, 223, and 221 may be another shape which would generally correspond to the shape of the pickets. In the example of FIG. 13, the pickets 330*a*-330*c* have a square cross section and therefore the openings 264, 266, 268 and 221, 223, and 225 generally would have a square cross section in that case.

Similarly, or identically, an end of locking strip 260*a* nearest the opening 264*a* can be inserted into the opening 228*a* of the rail 220*a* shown in FIG. 12. The locking strip 260*a* is inserted into the inner chamber 230*a*, so that the locking strip 260*a* lies flat, inside the inner chamber 230*a* on the protrusions or flanges 231*a* and 229*a* (or on the protrusions, flanges, or ribs 237*a* and 235*a* shown in FIG. 12, between the protrusions 231*a* and 229*a* (or 237*a* and 235*a*) and the wall 224*a*, and so that the openings 264*a*, 266*a*, and 268*a* of the locking strip 260*a* are aligned with the openings 225*a*, 223*a*, and 221*a*, respectively, of the rail 220*a*. When the locking strip 260*a* is inside the inner chamber 230*a* as described, with the openings 264*a*, 266*a*, and 268*a* aligned with the openings 225*a*, 223*a*, and 221*a*, the locking strip 260*a* is in an unlocked state with respect the rail 220*a*. The openings 264*a*, 266*a*, and 268*a* may be about the same size and shape as the openings 225*a*, 223*a*, and 221*a*, respectively. Although shown as square shaped, other shapes are possible as previously described.

Next, the pickets 330*a-c* may be inserted into the rails 220 and 220*a*. Ends 331*a-c* are inserted through the openings 264, 266, and 268 of the locking strip 260 and aligned openings 221, 223, and 225 of rail 220, respectively. Ends 332*a-c* are inserted through the openings 264*a*, 266*a*, and 268*a* of the locking strip 260*a* and aligned openings 221*a*, 223*a*, and 225*a* of rail 220*a*, respectively. The ends 331*a-c* and 332*a-c* are inserted so that parts of the locking strips 260 and 260*a* will be able to be slid into the slots 340*a-c* and 342*a-c* of the pickets 330*a-c*, respectively, to lock the pickets 330*a-c* in place so that they cannot move up in the direction U3 or down in the direction D13 as shown in FIG. 14B. FIG. 14A shows the pickets 330*a-c* inserted into the rails 220 and 220*a* with the locking strips 260 and 260*a* in an unlocked state. To put the locking strips 260 and 260*a* in a locked state, the locking strips 260 and 260*a* are slid in a direction D9 from the state of FIG. 14A to the state of FIG. 14B. Sliding the locking strips 260 and 260*a* in the direction D9 causes parts of the locking strips 260 and 260*a* to be inserted into the slots 340*a-c* and 342*a-c*. For example, FIG. 17A shows picket 330*a*. End 331*a* of picket 330*a* is inserted into the opening 264 of locking strip 260 (and through corresponding opening of rail 220 not shown in FIG. 17A). FIG. 17B shows the end 331*a* inserted through the opening 264 until the slot 340*a* is in a position where part of the locking strip 260 can slide into the slot 340*a*. The locking strip 260 can then be slid in the direction D11 with respect to the picket 330*a* until a substantial part of the locking strip 260 lies in the slot 340*a*, so that the picket 330*a* is prevented from moving, substantially up in the direction U3 or down in the direction D13 as shown in FIG. 17C. The picket 330*a* is thus locked into position, unless and until the locking strip 260 is slid back in the direction opposite D11 with respect to the picket 330*a* so that no part of the lock strip body portion 262 lies inside of the slot 340*a*, as in FIG. 17B. In the unlocked state of FIG. 17B, the picket 330*a* can be moved up in the direction U3 and down in the direction D13 in order to remove the picket 330*a* from the locking strip 260 (and thus from the rail 220 not shown in FIGS. 17A-C).

The ends 332*a-c* are inserted through the openings 221*a*, 223*a*, and 225*a* of the rail 220*a* and through the openings 264*a*, 266*a*, and 268*a* of the locking strip 260*a* in a similar or an identical manner as explained with reference to rail 220 and locking strip 260. The rail 220*a* and locking strip 260*a* is locked in place in a similar or identical manner with respect to pickets 330*a-c* as rail 220 and locking strip 260.

Referring to FIG. 15A, after the pickets 330*a-c* have been locked in place at both ends, next the ends of locking strips 240 and 240*a*, nearest openings 246 and 246*a*, respectively are inserted into the inner chambers 212 and 212*a*, respectively of posts 201 and 201*a*. The locking strip 240 is inserted into the inner chamber 212 of post 201 so that the locking strip 240 lies flat on the protrusions 216 and 218, and between the wall 208 and the protrusions 216 and 218, and so that the openings 244 and 246 of the locking strip 240 align with the openings 203 and 205, respectively, of the post 201. Similarly or identically, the locking strip 240*a* is inserted into the inner chamber 212*a* of post 201*a* so that the locking strip 240*a* lies flat on the protrusions 216*a* and 218*a*, and between the wall 208*a* and the protrusions 216*a* and 218*a*, and so that the openings 244*a* and 246*a* of the locking strip 240*a* align with the openings analogous to openings 203 and 205 for post 201*a*, respectively, of the post 201*a*.

After the locking strips 240 and 240*a* have been inserted in the previously described manner in the posts 201 and 201*a*, an end of the rail 220 is inserted into the opening 203, an opposing end of the rail 220 is inserted into an opening corresponding to 203 but for 201*a* (not shown), an end of the rail 220*a* is inserted into the opening 205 of the post 201, an opposing end of the rail 220*a* is inserted into a corresponding opening to opening 205, but for post 201*a*, not shown. The ends of the rails 220 and 220*a* (along with the ends of locking strips 260 and 260*a*) are also inserted through the appropriate openings of locking strips 240 and 240*a* which are aligned with openings of the posts 201 and 201*a*. For example, an end of rail 220 is inserted through opening 203 and through opening 244. An end of rail 220*a* is inserted through opening 205 and opening 246. The opposing end of rail 220 is inserted through opening 244*a* and opening of post 201*a* corresponding to opening 203. The opposing end of rail 220*a* is inserted through opening 246*a* and opening of post 201*a* corresponding to opening 205.

After the rails 220, 220*a*, locking strips 260 and 260*a* (not shown in FIG. 15C), posts 201 and 201*a*, and locking strips 240 and 240*a* have been assembled as in FIG. 15B, next the locking strips 240 and 240*a* are pushed downwards in the direction D10 to lock the rails 220 and 220*a* to the posts 201 and 201*a*, in the locked position of FIG. 15C. In the locked position of FIG. 15C the rails 220 and 220*a* cannot be moved substantially in the directions D9 or opposite D9, without moving the locking strips 240 and 240*a* back upwards in the direction U3, with respect to the posts 201 and 201*a*, to the position shown in FIG. 15D. In addition, the pickets 330*a-c* cannot be moved substantially up in the direction U3 or down in the direction D13.

In operation, the rail 220 can be locked or engaged (within inner chamber 212 of post 201) by the locking strip 240 as shown by FIGS. 16A-C. The end of the rail 220 nearest slot 234 can be inserted into the opening 244 of the locking strip 240, as shown by FIGS. 16A-B. Next, the rail 220 can be moved upwards in the direction U2 so that part of the body portion 242 of the locking strip 240 will be inserted into the slot 244 of the rail 240. The locking position of FIG. 16C, prevents the rail 220 from being moved in the direction D9 or opposite D9, unless the locking strip 240 is slid back down in the direction opposite U2 to the position of FIG. 16B. The end of the rail 220 near slot 236 may be locked to locking strip 240*a* in a similar or identical manner (within inner chamber 212*a* of post 201*a*). The ends of the rail 220*a* may be locked to locking strips 240 and 240*a* in a similar or identical manner (within inner chambers 212 and 212 of posts 201 and 201*a*, respectively), to the rail 220.

In one or more embodiments the present invention there may be a plurality of further ribs or protrusions, like the ribs or protrusions 6*c* and 2*c* shown in FIG. 1E, in addition to the ribs and/or protrusions 6*c* and 2*c*. The dimensions for the rails 1, 101, 220, locking strip 10, pickets 30*a-j*, posts 201 and 201*a*, locking strips 240 and 240*a*, locking strips 260 and 260*a*, and pickets 330*a*-330*c*, may vary depending on the particular type of fence desired. Although three pickets 330*a-c* are shown in FIG. 15C, the number of pickets used may vary depending upon the type of fence desired.

Although various openings, such including but not limited to openings 8*a*-8*j* of rail 1 shown in FIG. 1C, openings 203 and 205 shown of post 201 shown in FIG. 9A, openings 221, 223, and 225 of rail 220 shown in FIG. 10A, openings 244 and 246 of locking strip 240 shown in FIGS. 11A-B, openings 264, 266, and 268 of locking strip 260 shown in FIG. 12, are shown as square or substantially square, the openings could be replaced by openings of another shape for which a picket or rail is available. For example, The rail 220 shown in FIG. 16A could be replaced by a cylinder having a slot or notch, similar to notch 234, but semicircular shaped, and the locking strip 240 may have a circular opening in place of opening 244.

The post 201 of FIG. 9A may be modified so that the protrusions 218 and 216 connect together or are replaced by a plate going from the side 204 to the side 206, and having openings aligned with the openings 203 and 205. The openings of a plate replacing the protrusions 218 and 216 allow the rails 220 and 220*a* to be inserted through the openings 203 and 205 as shown by FIGS. 15A and 15B, then through the openings of the plate which replaces the protrusions 218 and 216, and then through the aligned openings 244 and 246 of the locking strip 240.

Figure 18A:
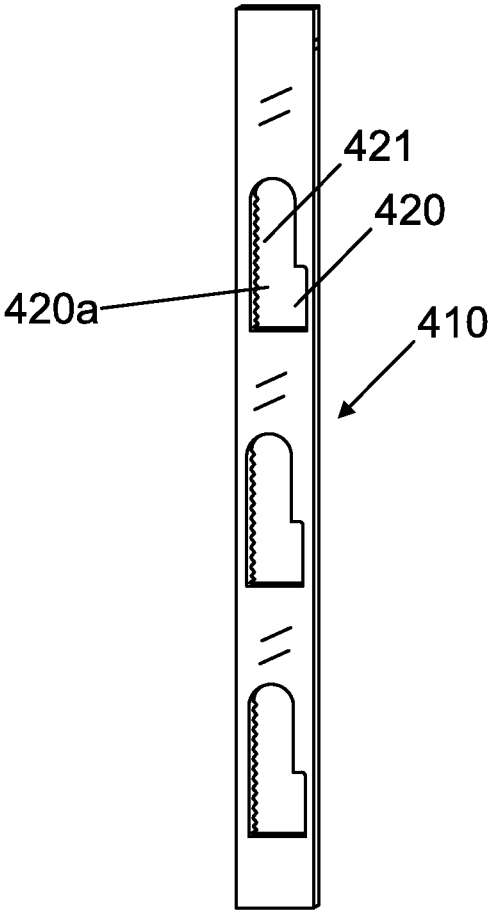
FIG. 18A shows a perspective view of an alternative locking strip having one or more serrated edges.

FIG. 18A shows a perspective view of an alternative locking strip 410 having one or more serrated edges. The locking strip 410 may be identical to locking strip 10 shown in FIGS. 2A and 2B with the exceptions that locking strip 410 has less openings analogous to openings 20 of strip 10, and there are internal serrated edges shown for locking strip 410. Locking strip 410 includes a plurality of openings 420, including opening 420*a*, each of which may be identical to each of openings 20 of locking strip 10 of FIGS. 2A-2B, with the exception of serrated edge 421 for opening 420*a* and similar serrated edges for the other openings of openings 420. The serrated edge 421 helps to reduce or eliminate rattling when the strip 410 is connected to the picket 30, in the manner shown in FIG. 8A for strip 10.

Figure 18B:
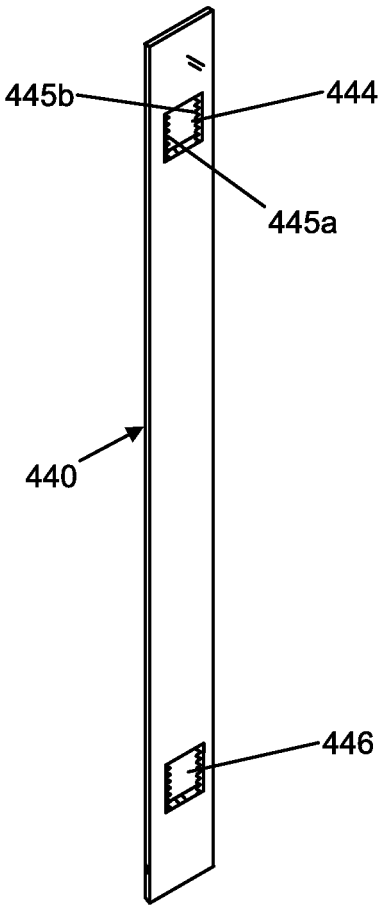
FIG. 18B shows a perspective view of another alternative locking strip having one or more serrated edges.

FIG. 18B shows a perspective view of another alternative locking strip 440 having one or more serrated edges. The locking strip 440 may be identical to locking strip 240 shown in FIGS. 11A and 11B with the exceptions that locking strip 440 has internal serrated edges shown for openings 444 and 446, corresponding to openings 244 and 246 of strip 240. Locking strip 440 has openings 444 and 446 which may be identical to openings 244 and 246, respectively, with the exception of serrated edges 445*a* and 445*b* for opening 444 and similar serrated edges for opening 446. The serrated edges 445*a* and 445*b* and similar or identical opening 446 helps to reduce or eliminate rattling when the strip 440 is connected to the rail 220, in the manner shown in FIG. 16C for strip 240.

FIG. 19A-F show top, bottom, left side, right side, front, and rear views of a device 500 in accordance with another embodiment of the present invention. The device 500 includes a curved portion 502 and flat portion 506, an inner chamber 504, and legs 508 and 510. The curved portion 502 and the flat portion 506 together, in at least one embodiment, make up a closed housing which encloses or encapsulates the inner chamber or region 504. The combination of portions 502, 504, and 506 may be called a section which can be compressed or which is elastic.

Figure 19A:
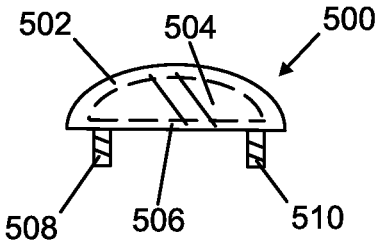
FIG. 19A shows a top view of a device in accordance with another embodiment of the present invention.
Figure 19B:
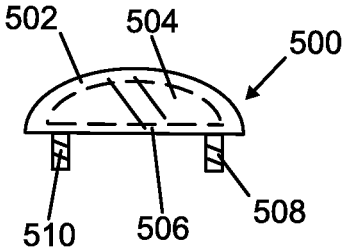
FIG. 19B shows a bottom view of the device of FIG. 19A.
Figure 19C:
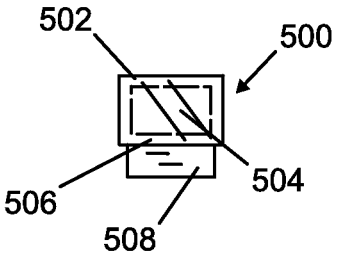
FIG. 19C shows a left side view of the device of FIG. 19A.
Figure 19D:
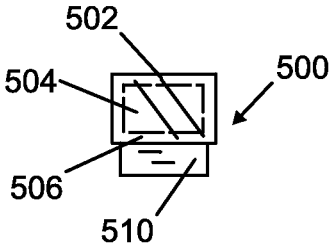
FIG. 19D shows a right side view of the device of FIG. 19A.
Figure 19E:
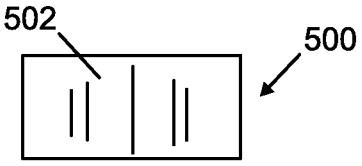
FIG. 19E shows a front view of the device of FIG. 19A.
Figure 19F:
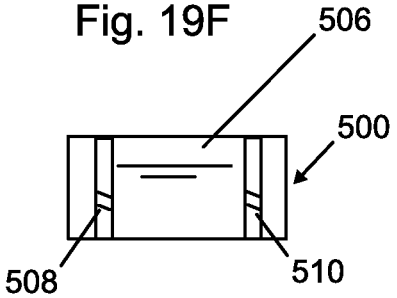
FIG. 19F shows a rear view of the device of FIG. 19A.
Figure 20A:
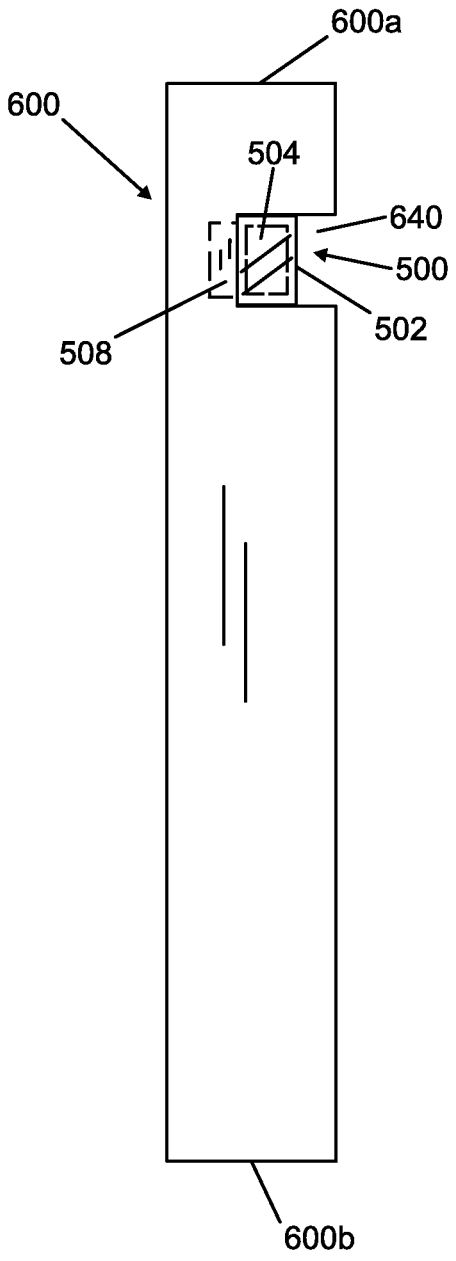
FIG. 20A shows a left side view of the device of FIG. 19A inserted into a member.
Figure 20B:
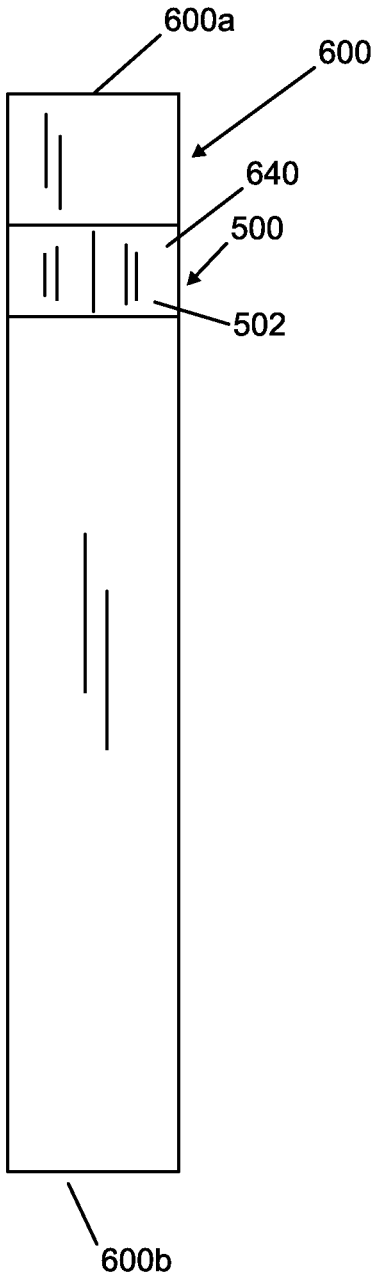
FIG. 20B shows a front view of the device of FIG. 19A inserted into the member of FIG. 20A.
Figure 20C:
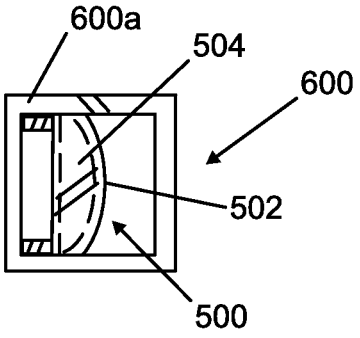
FIG. 20C shows a top view of the member of FIG. 20A, with a partial top view of the device of FIG. 19A inserted into the member of FIG. 20A, and with the device of FIG. 19A in a non compressed or rest state.
Figure 20D:
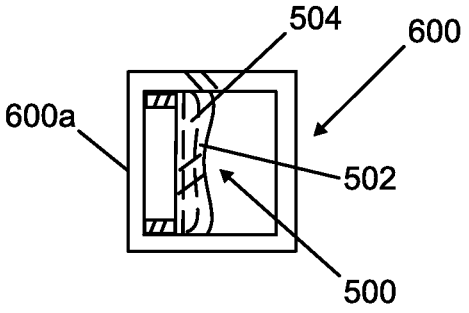
FIG. 20D shows a top view of the member of FIG. 20A, with a partial top view of the device of FIG. 19A inserted into the member of FIG. 20A, and with the device of FIG. 19A in a compressed or flexed state.

FIG. 20A shows a left side view of the device 500 of FIG. 19A inserted into a member 600. The member 600 may be part of a portion of a picket, identical to picket 30 shown in FIGS. 3A and 3B. The picket or member 600 may include a slot 640 and ends 600*a* and 600*b*. FIG. 20B shows a front view of the device 500 of FIG. 19A inserted into the member 600 of FIG. 20A. FIG. 20C shows a top view of the member 600 of FIG. 20A, with a partial top view of the device 500 of FIG. 19A inserted into the member 600 of FIG. 20A, and with the device 500 of FIG. 19A in a non compressed or rest state. FIG. 20D shows a top view of the member 600 of FIG. 20A, with a partial top view of the device 500 of FIG. 19A inserted into the member 600 of FIG. 20A, and with the device 500 of FIG. 19A in a compressed or flexed state.

Figure 21:
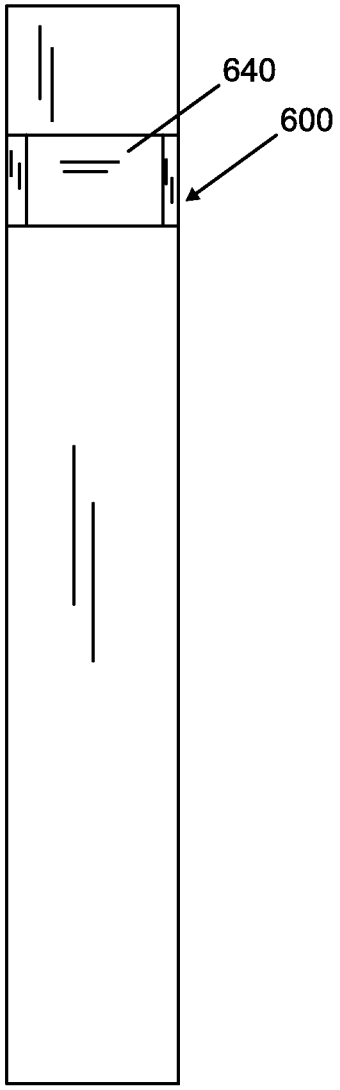
FIG. 21 shows a front view of the member of FIG. 20A without the device of FIG. 19A.
Figure 22:
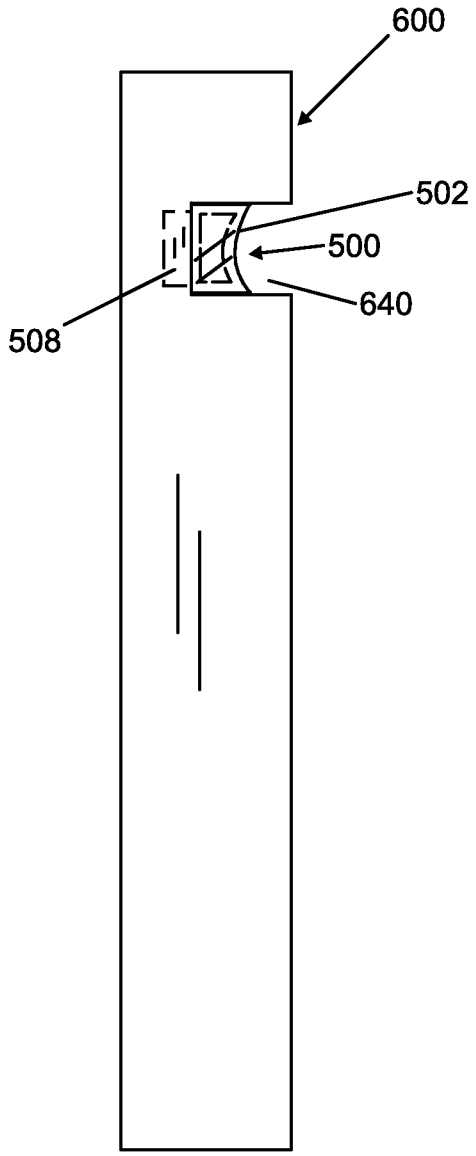
FIG. 22 shows a left side view of the device of FIG. 19A inserted into the member of FIG. 20A, and with the device of FIG. 19A in a compressed or flexed state.

FIG. 21 shows a front view of the member 600 of FIG. 20A without the device 500 of FIG. 19A. FIG. 22 shows a left side view of the device 500 of FIG. 19A inserted into the member 600 of FIG. 20A, and with the device 500 of FIG. 19A in a compressed or flexed state.

Figure 23:
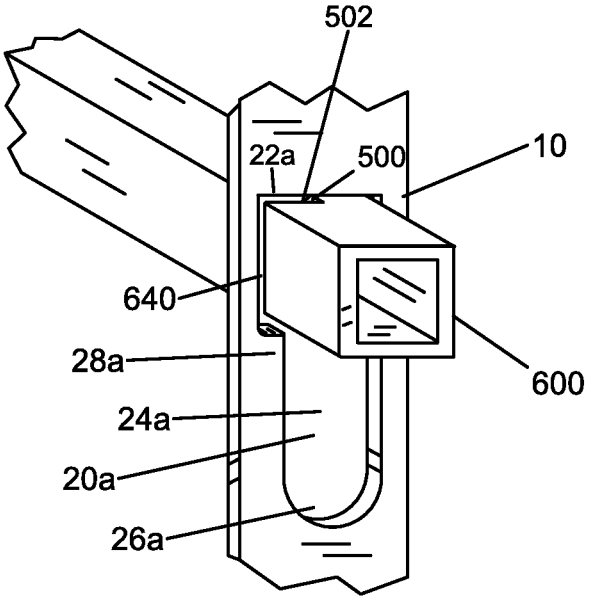
FIG. 23 shows a perspective view of the member of FIG. 20A and the locking strip of FIGS. 2A and 2B with the locking strip of FIGS. 2A-2B shown in a first insertion state with respect to the member of FIG. 20A.

FIG. 23 shows a perspective view of the member of FIG. 20A and with a portion of the locking strip 10 of FIGS. 2A and 2B with the portion of the locking strip 10 of FIGS. 2A-2B shown in a first insertion state with respect to the member of FIG. 20A. In the state of FIG. 23, the portion 502 of the device 500 is in the noncompressed state shown in FIG. 20C.

Figure 24:
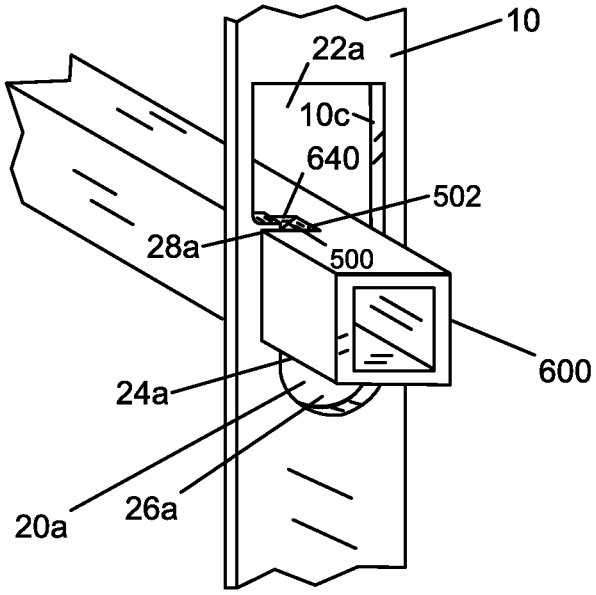
FIG. 24 shows a perspective view of the member of FIG. 20A and the locking strip of FIGS. 2A and 2B with the locking strip of FIGS. 2A-2B shown in a second insertion state with respect to the member of FIG. 20A.

FIG. 24 shows a perspective view of the member of FIG. 20A and the portion of the locking strip 10 of FIGS. 2A and 2B with the portion of the locking strip 10 of FIGS. 2A-2B shown in a second insertion state with respect to the member of FIG. 20A. In the state of FIG. 24, the portion 502 of the device 500 is in a compressed state shown in FIG. 20D. In the compressed state, the edge or portion 28*a* of the locking strip 10 presses against the portion 502 of the device 500 which pushes against an inside edge 10*c*.

The device 500 can be used with the embodiments previously and shown with reference to FIGS. 1A-18B. In particular, one can substitute FIGS. 23-24 for FIGS. 8A and 8B, and use the device with the fences and/or other devices as shown in FIGS. 1A-18B. For example, rigid members or rails 220 and 220*a* in FIG. 15B can be used with four devices 500 (one for each end of rail 220 and 220*a*) so that locking strips 240 and 240*a* will be more tightly locked in and is less likely to move when attached in the fence structure as shown in FIG. 15B.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising
a first device;
a first rigid member; and
a first locking strip comprising a first slot, wherein the first slot has a first portion and a second portion, wherein a width of the first portion is greater than the second portion;
wherein the first device has a compressible section;
wherein the first device is configured to fit within a first slot of the first rigid member;
wherein the first locking strip, the first rigid member, and the first device are configured so that the first locking strip can be placed in a first state in which a first end of the first rigid member is inserted into the first portion of the first slot of the first locking strip and the compressible section of the first device is not compressed by the first locking strip and in a second state in which the first end of the first rigid member is inserted into the second portion of the first slot of the first locking strip and the compressible section of the first device is compressed by the first locking strip.

2. The apparatus of claim 1 wherein
the first device includes two legs in addition to the compressible section;
and wherein the two legs substantially span the distance between two walls of the first rigid member.

3. The apparatus of claim 1 wherein
the compressible section of the first device includes a curved portion and a flat portion and an inner chamber which is enclosed by the combination of the curved portion and the flat portion of the first device.

4. The apparatus of claim 1 further comprising
a first post;
a second post;
a second device having a compressible section; and
a second locking strip;
wherein the second device is configured to fit within a second slot of the first rigid member;
wherein the first and the second posts are configured to be connected together by the first rigid member to form a fence structure;
wherein the first locking strip is configured to be inserted at least partially into the first post;
wherein the second locking strip is configured to be inserted at least partially into the second post;
wherein the second locking strip, the first rigid member and the second device are configured so that the second locking strip can be placed in a third state in which a second end, opposite the first end, of the first rigid member is inserted into a first slot of the second locking strip and the compressible section of the second device is not compressed and in a fourth state in which the second end of the first rigid member is partially inserted into the first slot of the second locking strip and the compressible section of the second device is compressed.

5. The apparatus of claim 4 further comprising a third device having a compressible section;

a fourth device having a compressible section;

and a second rigid member;

wherein the third device is configured to fit within a first slot of the second rigid member;

wherein the fourth device is configured to fit within a second slot of the second rigid member;

wherein the first and the second posts are configured to be connected together by the first and second rigid members to form the fence structure;

wherein the first locking strip, the second rigid member and the third device are configured so that the first locking strip can be placed in a fifth state in which a first end of the second rigid member, is inserted into a second slot of the first locking strip and the compressible section of the third device is not compressed and in a sixth state in which the first end of the second rigid member is inserted into the second slot of the first locking strip and the compressible section of the third device is compressed; and wherein the second locking strip, the second rigid member and the fourth device are configured so that the second locking strip can be placed in a fifth state in which a second end, opposite the first end, of the second rigid member, is inserted into a second slot of the second locking strip and the compressible section of the fourth device is not compressed and in a sixth state in which the second end of the second rigid member is inserted into the second slot of the second locking strip and the compressible section of the fourth device is compressed.

6. A method comprising placing a first device within a first slot of a first rigid member, wherein the first device includes a compressible section;

providing a first locking strip comprising a first slot, wherein the first slot has a first portion and a second portion, wherein a width of the first portion is greater than the second portion;

placing the first locking strip in a first state in which a first end of the first rigid member is inserted into the first portion of the first slot of the first locking strip and the compressible section of the first device is not compressed by the first locking strip; and placing the first locking strip in a second state in which the first rigid member is partially inserted into the second portion of the first slot of the first locking strip and the compressible section of the first device is compressed by the first locking strip.

7. The method of claim 6 wherein the first device includes two legs in addition to the compressible section;

and wherein the two legs of the first device substantially span the distance between two walls of the rigid member.

8. The method of claim 6 wherein the compressible section of the first device includes a curved portion and a flat portion and an inner chamber which is enclosed by the combination of the curved portion and the flat portion of the first device.

9. The method of claim 6 further comprising fitting a second device having a compressible section within a second slot of the first rigid member;

inserting the first locking strip at least partially into a first post;

inserting a second locking strip at least partially into a second post;

placing the second locking strip in a third state in which a second end, opposite the first end, of the first rigid member is inserted into a first slot of the second locking strip and the compressible section of the second device is not compressed; and placing the second locking strip in a fourth state in which the second end of the first rigid member is inserted into the first slot of the second locking strip and the compressible section of the second device is compressed;

and wherein a fence structure is formed including the first and second posts and first rigid member.

10. The method of claim 9 further comprising fitting a third device having a compressible section within a first slot of a second rigid member;

fitting a fourth device having a compressible section within a second slot of the second rigid member;

placing the first locking strip in a fifth state in which a first end of the second rigid member is inserted into a second slot of the first locking strip and the compressible section of the third device is not compressed;

placing the first locking strip in a sixth state in which the first end of the second rigid member is inserted into the second slot of the first locking strip and the compressible section of the third device is compressed;

placing the second locking strip in a fifth state in which a second end, opposite the first end, of the second rigid member is inserted into a second slot of the second locking strip and the compressible section of the fourth device is not compressed; and placing the second locking strip in a sixth state in which the second end of the second rigid member is inserted into the second slot of the second locking strip and the compressible section of the fourth device is compressed;

and wherein the fence structure formed includes the second rigid member.

* * * * *